US012139843B2

(12) United States Patent
Bauer et al.

(10) Patent No.: US 12,139,843 B2
(45) Date of Patent: Nov. 12, 2024

(54) FOREIGN SUBSTRATE COLLECTOR FOR A LAUNDRY APPLIANCE

(71) Applicant: WHIRLPOOL CORPORATION, Benton Harbor, MI (US)

(72) Inventors: Evan Kristopher Bauer, St. Joseph, MI (US); Tarun Sai Yadav Godha, St. Joseph, MI (US); Bharadwaj J, Chennai (IN); Skylar Rhae Kleindienst, Benton Harbor, MI (US); Sayer James Murphy, St. Joseph, MI (US); Sachin Nilawar, Pune (IN); Stephen D. Ostdiek, St. Joseph, MI (US); B. Shiva, Hyderabad (IN); Ryan James Van Zoest, Benton Harbor, MI (US); Michelle Flachs Croce, Verona, WI (US); Karthick Kumar Dhanapal, Chennai (IN); Jun Young Park, Benton Harbor, MI (US); Heather A. Hellmuth, St. Joseph, MI (US); Michael A. Ledford, St. Joseph, MI (US); Meagan K. VanderVelde, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 12 days.

(21) Appl. No.: 17/552,461

(22) Filed: Dec. 16, 2021

(65) Prior Publication Data

US 2022/0220657 A1 Jul. 14, 2022

Related U.S. Application Data

(60) Provisional application No. 63/136,315, filed on Jan. 12, 2021.

(51) Int. Cl.
*D06F 39/10* (2006.01)
*D06F 39/12* (2006.01)
(Continued)

(52) U.S. Cl.
CPC ..... *D06F 39/10* (2013.01); *D06F 39/12* (2013.01); *D06F 58/10* (2013.01); *D06F 58/22* (2013.01)

(58) Field of Classification Search
CPC ..... D06F 37/06; D06F 39/083; D06F 39/10; D06F 58/22; D06F 39/14; D06F 37/065;
(Continued)

(56) References Cited

U.S. PATENT DOCUMENTS 2,222,139 A 11/1940 Clark
2,780,009 A 2/1957 Stickel
(Continued)

FOREIGN PATENT DOCUMENTS

CA 2924616 A1 4/2015
CN 1696384 A 11/2005
(Continued)

OTHER PUBLICATIONS

Asanuma et al., "Drum Washing Machine", Mar. 2004, JP-2004089339-A—Machine Translation (Year: 2004).*
(Continued)

*Primary Examiner* — David G Cormier
*Assistant Examiner* — Thomas Bucci
(74) *Attorney, Agent, or Firm* — Price Heneveld LLP

(57) ABSTRACT

A laundry appliance includes a cabinet. A door is operably coupled to the cabinet. A drum is disposed within the cabinet proximate to the door. A lifter is disposed within and operably coupled to the drum. A foreign substrate collector is disposed within the lifter.

20 Claims, 34 Drawing Sheets

(51) Int. Cl.
*D06F 58/10* (2006.01)
*D06F 58/22* (2006.01)

(58) Field of Classification Search
CPC ..... D06F 37/28; D06F 37/145; D06F 58/10; D06F 39/12; A47L 25/005
USPC ..... 68/13 R
See application file for complete search history.

(56) References Cited

U.S. PATENT DOCUMENTS 3,022,654 A 2/1962 Aberle
3,197,886 A * 8/1965 Brame ..... D06F 58/00 34/607
3,595,036 A * 7/1971 DePas ..... D06F 58/203 68/17 R
3,650,673 A * 3/1972 Ehner ..... D06F 35/00 8/158
3,999,304 A * 12/1976 Doty ..... D06F 58/22 34/90
4,920,662 A 5/1990 Seeburger
5,210,960 A * 5/1993 LaRue ..... F26B 25/007 D32/30
5,463,820 A * 11/1995 La Rue ..... D06F 58/22 34/235
5,535,478 A * 7/1996 Thompson ..... A47L 9/02 15/419
6,038,732 A * 3/2000 McKnight ..... A47L 9/02 15/414
6,481,047 B1 * 11/2002 Schaefer ..... A47L 7/00 15/328
6,564,591 B2 5/2003 Noyes et al.
7,441,345 B2 10/2008 Taylor
7,690,227 B2 4/2010 Cho et al.
7,766,988 B2 8/2010 Roberts
7,827,830 B2 11/2010 Kim
7,836,733 B2 11/2010 Bae et al.
8,001,650 B2 * 8/2011 Trotter ..... A47L 9/244 15/314
8,056,254 B2 * 11/2011 Loffler ..... D06F 58/22 34/82
8,317,908 B2 11/2012 Fraden
8,869,421 B2 * 10/2014 Kim ..... D06F 58/22 34/418
9,593,441 B2 * 3/2017 Gregory ..... D06F 58/22
9,847,906 B1 12/2017 White
9,951,464 B2 * 4/2018 Lee ..... D06F 58/22
10,100,459 B2 * 10/2018 Groppel ..... D06F 58/10
10,280,551 B2 5/2019 Sweigart
10,309,050 B2 6/2019 Lee et al.
10,443,177 B2 10/2019 Kim et al.
10,531,784 B2 1/2020 Sweigart
10,941,513 B2 * 3/2021 MacDonald, III ..... D06F 58/22
11,767,633 B2 * 9/2023 Bellinger ..... D06F 37/26 34/91
2005/0252253 A1 11/2005 Ahn
2005/0268483 A1 * 12/2005 Park ..... D06F 39/12 34/603
2006/0005581 A1 1/2006 Banba
2006/0123652 A1 * 6/2006 Chung ..... D06F 58/22 34/605
2007/0144028 A1 * 6/2007 Audet ..... D06F 58/22 34/85
2008/0271336 A1 * 11/2008 Doh ..... D06F 58/22 34/82
2008/0282747 A1 * 11/2008 Kim ..... D06F 37/065 68/13 R
2009/0229318 A1 * 9/2009 Yoo ..... D06F 39/10 68/235 R
2009/0235549 A1 * 9/2009 Cartwright ..... D06F 58/50 34/92
2010/0050465 A1 3/2010 Im et al.
2011/0271543 A1 * 11/2011 Kim ..... D06F 58/22 34/90
2012/0036730 A1 * 2/2012 Sans Rovira ..... D06F 58/20 34/85
2012/0180532 A1 * 7/2012 Park ..... D06F 17/10 68/133
2015/0096128 A1 * 4/2015 Sawford ..... D06F 39/14 68/17 R
2016/0153136 A1 * 6/2016 Yoichi ..... D06F 58/22 34/604
2017/0022652 A1 * 1/2017 Lee ..... D06F 39/08
2018/0023242 A1 * 1/2018 Kang ..... D06F 58/20 34/595
2018/0245273 A1 * 8/2018 Bocchino ..... D06F 58/22
2019/0093279 A1 * 3/2019 Grider ..... D06F 58/22
2020/0238202 A1 * 7/2020 Renz ..... B01D 29/09
2020/0248369 A1 8/2020 Lee et al.
2021/0002811 A1 * 1/2021 Bellinger ..... D06F 58/203

FOREIGN PATENT DOCUMENTS

CN 100494551 C 6/2009
CN 101498089 12/2010
CN 101372806 B 9/2013
CN 103403246 4/2016
CN 105658865 A 6/2016
CN 209412541 U 9/2019
CN 211815029 10/2020
CN 211815029 U * 10/2020
EP 2118355 B1 11/2012
EP 2695986 7/2016
EP 2085507 B1 6/2019
ES 2399369 T3 3/2013
IT 20070157 9/2008
JP 1230394 9/1989
JP 2003260292 9/2003
JP 2003260292 A 9/2003
JP 2004089339 3/2004
JP 2004089339 A * 3/2004 ..... D06F 37/06
JP 3817502 B2 9/2006
JP 4030523 B2 1/2008
JP 2009050337 A 3/2009
JP 4474447 B2 6/2010
KR 100213131 B1 5/1999
KR 100392394 B1 7/2003
KR 1020050108612 A 11/2005
KR 1020060122256 A 11/2006
KR 100709943 B1 4/2007
KR 1020070076313 A 7/2007
KR 100751781 B1 8/2007
KR 200465504 Y1 2/2013
KR 20130037427 4/2013
KR 20130037427 A * 4/2013
KR 101443605 B1 9/2014
KR 20160068825 6/2016
KR 1020190012354 A 2/2019
MX 2016004193 A 6/2016
PL 2118355 T3 4/2013
TW 201525228 7/2015
WO 2007124805 A1 11/2007
WO 2008107762 A2 9/2008
WO 2008123695 A2 10/2008
WO 2012138136 A2 10/2012
WO 2015049544 A1 4/2015
WO 19009635 1/2019

OTHER PUBLICATIONS

Kim, "Roller Device for Washing Machine", Apr. 2013, KR-20130037427-A—Machine Translation (Year: 2013).*
Zhong, "Detachable Shoe-Washing and Clothes-Washing Dual-Purpose Washing Machine Inner Barrel Device", Oct. 2020, CN-211815029-U—Machine Translation (Year: 2020).*
How to Remove Unwanted Pet Hair from Laundry, https://speedqueen.com/how-to-remove-unwanted-pet-hair-from-laundry/, Sep. 21, 2020, 4 pages.

* cited by examiner

FOREIGN SUBSTRATE COLLECTOR FOR A LAUNDRY APPLIANCE

CROSS-REFERENCE TO RELATED APPLICATION

This application claims priority and the benefit under 35 U.S.C. § 119(e) to U.S. Provisional Patent Application No. 63/136,315, filed Jan. 12, 2021, entitled FOREIGN SUBSTRATE COLLECTOR FOR A LAUNDRY APPLIANCE, which is incorporated herein by reference in its entirety.

BACKGROUND OF THE DISCLOSURE

The present disclosure generally relates to a laundry appliance, and more specifically, to a foreign substrate collector for a laundry appliance.

SUMMARY OF THE DISCLOSURE

According to one aspect of the present disclosure, a laundry appliance includes a cabinet. A door is operably coupled to the cabinet. A drum is disposed within the cabinet proximate to the door. A lifter is disposed within and operably coupled to the drum. A foreign substrate collector is disposed within the lifter.

According to another aspect of the present disclosure, a laundry appliance includes a cabinet. A door is operably coupled to the cabinet and includes a barrier layer. A drum is disposed within the cabinet proximate to the door. A lifter is disposed within and operably coupled to the drum. A foreign substrate collector is disposed proximate the barrier layer.

According to yet another aspect of the present disclosure, a laundry appliance includes a cabinet. A door is operably coupled to the cabinet. A drum is disposed within the cabinet proximate to the door. A lifter is disposed within and operably coupled to the drum. A foreign substrate collector is disposed proximate the drum. The foreign substrate collector includes a plurality of rollers with frictional members. The frictional members rotate against one another and against articles being processed. The frictional members collect foreign substrate particles from the articles and collects the foreign substrate particles on the plurality of rollers.

These and other features, advantages, and objects of the present disclosure will be further understood and appreciated by those skilled in the art by reference to the following specification, claims, and appended drawings.

Figure 1:
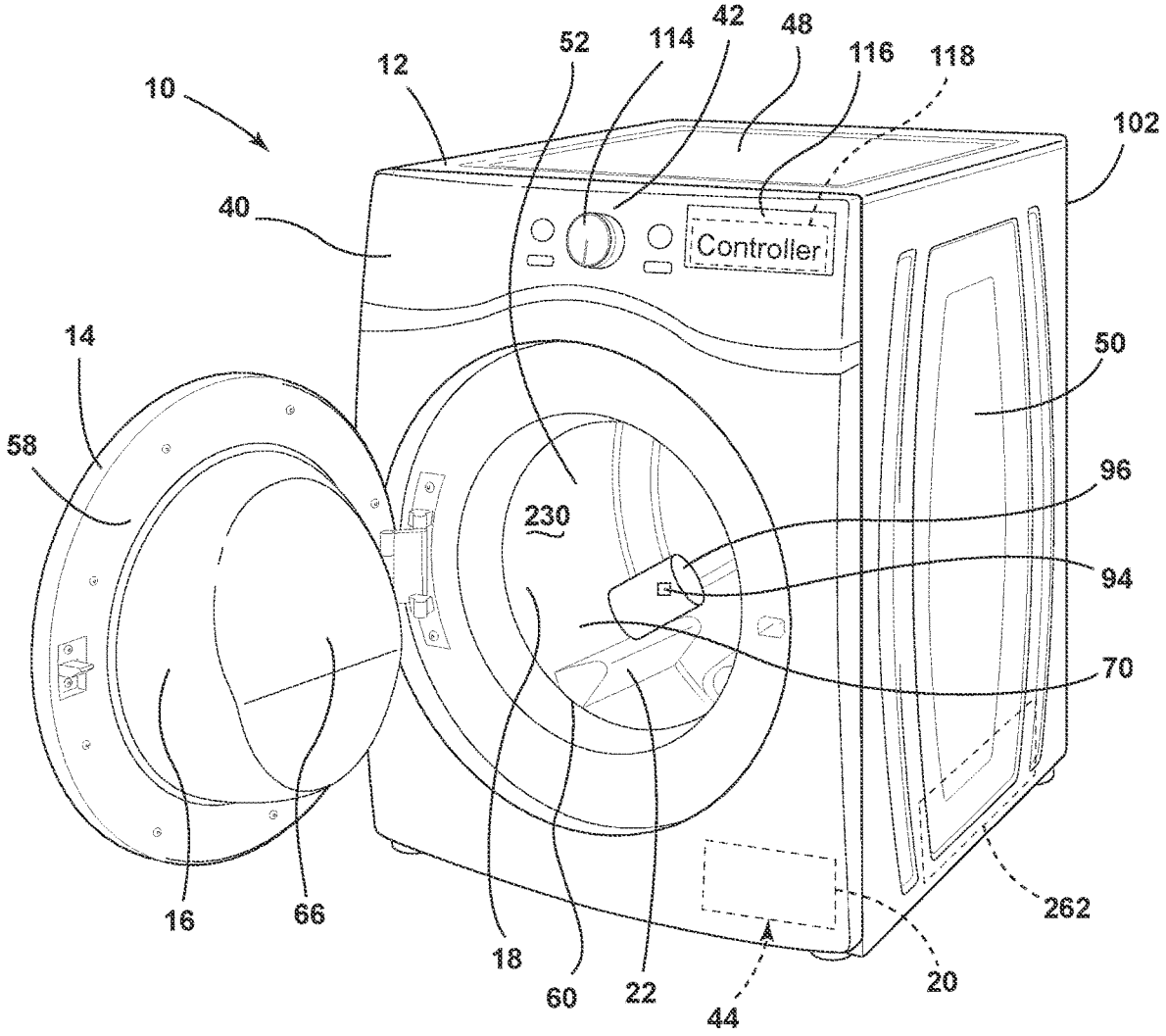
FIG. 1 is a front perspective view of a laundry appliance of the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a foreign substrate collector. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-38, reference numeral 10 generally designates a laundry appliance that includes a cabinet 12. A door 14 is operably coupled to the cabinet 12. Where the door 14 is positioned within a front panel of the cabinet 12, the door 14 typically includes a barrier layer 16. A drum 18 is disposed within the cabinet 12 proximate to the door 14, and a pump 20 for a fluid delivery system 28 is operably coupled to the drum 18 for moving a flow of wash fluid 26 into and away from the drum. A lifter 22 is disposed within and operably coupled to the drum 18.

Figure 2:
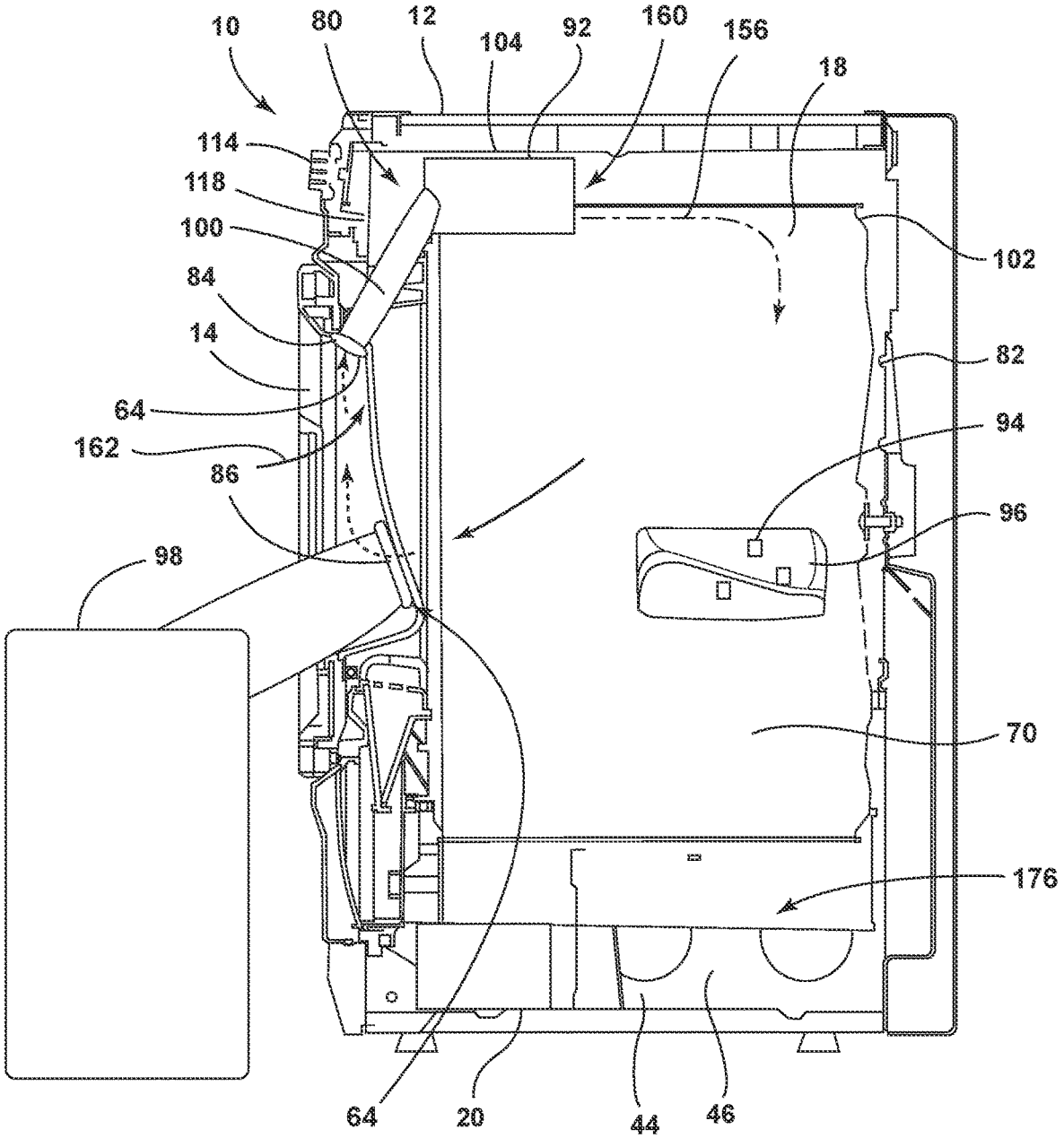
FIG. 2 is a cross-sectional view of a laundry appliance of the present disclosure operably coupled to an external receiving container.
Figure 3:
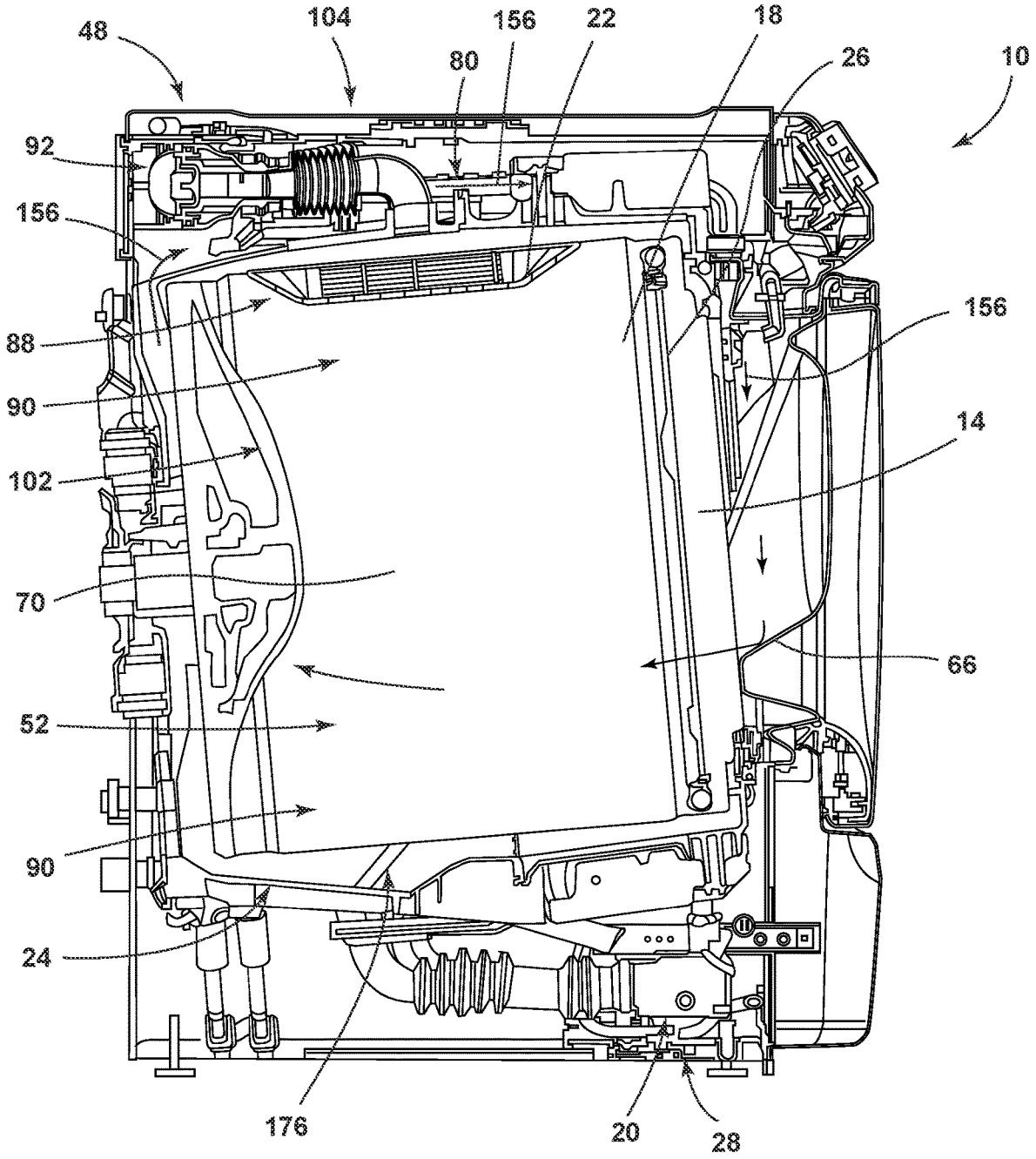
FIG. 3 is a cross-sectional view of a laundry appliance of the present disclosure.
Figure 4:
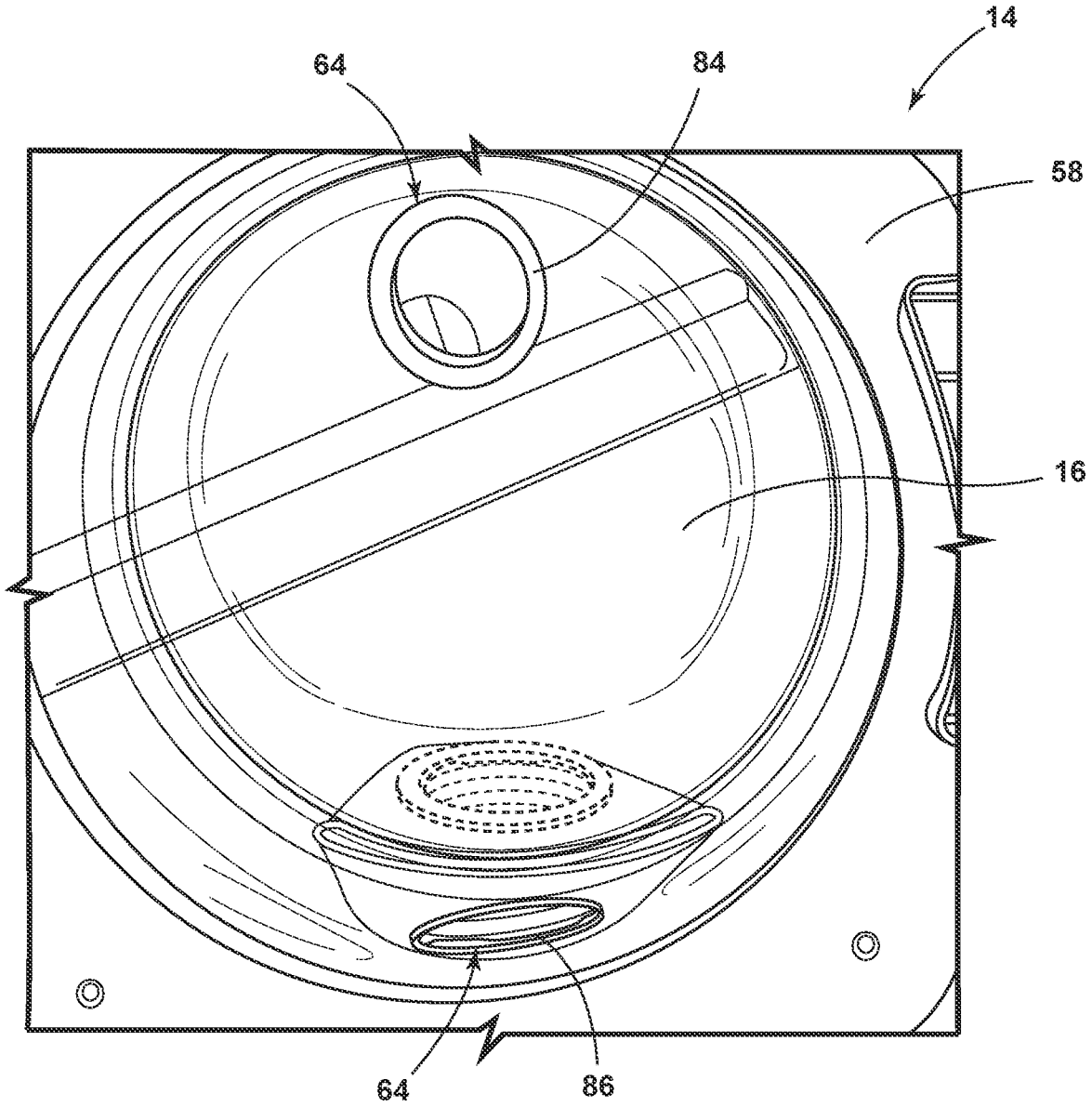
FIG. 4 is a partial side perspective view of a door of the present disclosure with a first filter and a second filter.
Figure 5:
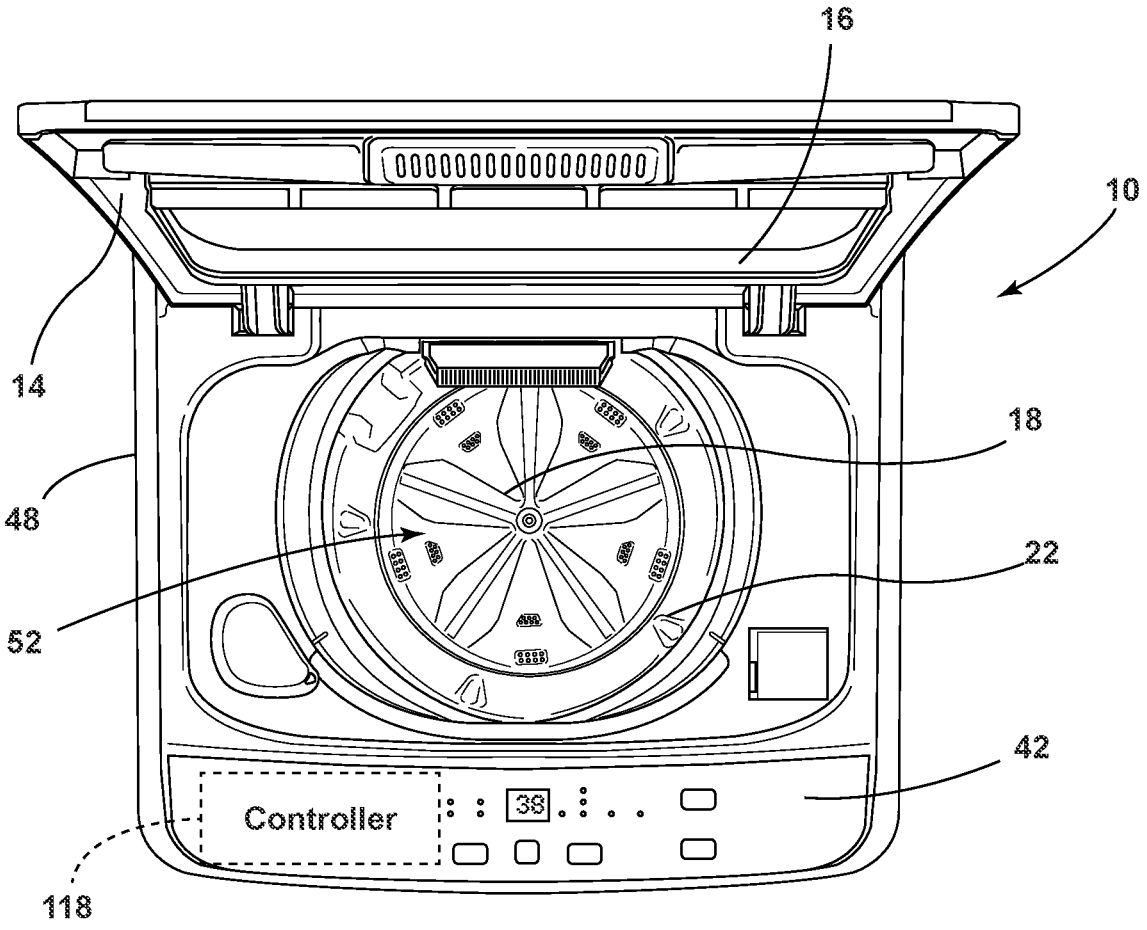
FIG. 5 is a top perspective view of a vertical axis laundry appliance of the present disclosure.

Referring to FIGS. 1 and 2, the laundry appliance 10 is illustrated in FIG. 1 as a horizontal axis washer. Additionally or alternatively, the laundry appliance 10 is illustrated in FIG. 5 as a vertical axis washer, such that the door 14 of the laundry appliance 10 is disposed on a top panel of the cabinet 12. It is further contemplated that the constructions described herein may be applicable for a washer, a dryer, and/or a combination laundry appliance. A user interface 42 can be coupled to the cabinet 12 to select and control the various cycles of the laundry appliance 10. In addition, a machine compartment 44 may be adjacent to the door 14 and is illustrated within a cavity 46 below the door 14. The cabinet 12 also includes a top portion 48 and side portions 50 in addition to the front portion 40. For performing various drying operations, the laundry appliance 10 can operate according to various operating systems. These operating systems can include, but are not limited to, an exhaust dryer, recirculating dryer, heat pump dryer, condensing dryer, and other similar operating systems.

The door 14 can be operably coupled to either the front portion 40 or the top portion 48 of the cabinet 12, depending on the configuration of the laundry appliance 10. It is generally contemplated that the door 14 is hingedly coupled to the cabinet 12 to provide selective access to an interior cavity 52 defined by the drum 18 in either the vertical, the horizontal or the angular or oblique axis configuration of the laundry appliance 10. A frame 58 of the door 14 may be generally circular to correspond with a generally circular opening 60 defined by the cabinet 12. Typically, the frame 58 is formed from a rigid, metallic material. However, it is also contemplated that the frame 58 may be formed from other materials known in the art, such as plastics.

With further reference to FIGS. 1 and 2, the barrier layer 16 is positioned within the frame 58 of the door 14 to block materials from exiting the drum 18 of the laundry appliance 10. For example, during a wash cycle, clothing is typically saturated with a combination of water and laundry chemistry, typically detergent, and during the wash cycle the clothes are rotated, spun, and generally agitated, such that, without the barrier layer 16, clothing may exit the drum 18. The barrier layer 16 may generally have a fishbowl construction. It is also contemplated that the barrier layer 16 may include a deflector 66 to help minimize water leakage from the drum 18, such that the deflector 66 typically redirects water inward toward the drum 18. This deflector 66 can also be used to spread and distribute wash fluid 26 and the articles being processed within the drum.

Referring to FIGS. 1-4, the laundry appliance 10 includes a ventilation assembly 80 operably coupled to the cabinet 12 and the drum 18. The drum 18 can include a perforated wall 70 that is configured to provide for the passage of fluid, in the form of liquid and air, into and out of the drum 18. The ventilation assembly 80 can include first and second filters 84, 86 operably coupled to the barrier layer 16 of the door 14. The first and second filters 84, 86 are typically positioned within dedicated filter openings 64 within the barrier layer 16 to provide for the movement of material therethrough.

The first and second filter 84, 86 can be incorporated into the deflector 66 of the barrier layer 16.

Additionally or alternatively, the ventilation assembly 80 can include a foreign substrate collector 88 operably coupled to a rear interior portion 90 of the cabinet 12 proximate to the drum 18. The ventilation assembly 80 also includes a blower 92 operably coupled to an airflow path 160 that moves process air 156 through the cabinet 12 and through the drum in particular. The blower 92 is configured to forcibly direct process air 156 through apertures 82 that are defined by the drum 18, typically the rear wall of the drum 18, to dispel particles of foreign substrates 94 from clothing and/or fabric items 96 that may be disposed within the drum 18.

The ventilation assembly 80 is illustrated with the first and second filters 84, 86 being operably coupled to the door 14 of the laundry appliance 10. It is generally contemplated that the first filter 84 is operably coupled to the blower 92. The second filter 86 is operably coupled to an external receiving container 98 configured to collect the foreign substrates 94 removed by the blower 92 and collected by at least the second filter 86. It is generally contemplated that the external receiving container 98 can include a dedicated air handler that operates to define a suction that creates an at least partial vacuum chamber within the receiving container 98. This suction is configured to draw in the foreign substrates 94 from the second filter 86 and the drum 18 and into the receiving container 98. The at least partial vacuum chamber of the external receiving container 98 assists in retaining the foreign substrates 94 within the external receiving container 98 during operation of the laundry appliance 10, in addition to drawing the foreign substrates 94 into the external receiving container 98. At the completion of a particular laundry cycle, or at another intermittent time period, the receiving container 98 can be emptied to dispose of the captured foreign substrates 94. In certain aspects of the device, the first and second filters 84, 86 can be operable during performance of a pet cycle 122. In such an aspect of the device, the first and second filters 84, 86 as well as the filter openings 64 can be operable to move to an open position during a pet cycle 122. This allows the recovery ambient air 162 to move into the drum 18 and also allow the process air 156 to move to the external receiving container 98 through the second filter 86. At the conclusion of the pet cycle 122, the first and second filters 84, 86 and the associated filter openings 64 are operable to a closed position to perform during a standard wash cycle 172. Typically, where the appliance 10 is a dryer only, the first filter 84 will be used to draw in ambient air 162 into the drum 18 and the second filter 86 will be used to expel used process air 156, usually containing foreign substrates 94 out of the appliance 10. Where the appliance 10 is a combination washer and dryer, the first and second filters 84, 86 will recirculate process air 156 within the appliance 10.

In certain aspects of the device, it is contemplated that the receiving container 98 can be incorporated into a portion of the appliance 10 and inside the door 14 or the cabinet 12. By way of example, and not limitation, where the receiving container 98 is incorporated into the door 14 of the appliance 10, the process air 156 can flow from the drum 18 and into one of the first and second filters 84, 86, through an air channel defined within the door 14 and then out the other of the first and second filters 84, 86. The receiving container 98 can be disposed within the air channel within the door 14. The receiving container 98 can also be positioned within the door 14 and proximate one or both of the first and second filters 84 86. It is contemplated that the receiving container 98 can be positioned within the cabinet 12 near the opening for the door 14. In these various aspects, the receiving container 98 can include a removable collector 88 or other filtration member that can be used to dispose of the captured particles of foreign substrates 94.

With further reference to FIGS. 1-4, it is also contemplated that the blower 92 can be operably coupled to the first filter 84 to project an airflow through the first filter 84 into the drum 18. In such configuration, the blower 92 is operably and selectively coupled to the first filter 84 via a hose 100 operably coupled to the blower 92. The hose 100 selectively couples to the first filter 84 in a closed position of the door 14. For example, the door 14 is unattached to the hose 100 when the user opens the door 14 to access the interior cavity 52. Once the door 14 is closed and latched to the cabinet 12, then the hose 100 is operably coupled to the first filter 84 to direct the airflow into the interior cavity 52. In certain aspects of the device, the first filter 84 can be incorporated into an ambient air 162 or recovery air filter opening 64 that is used to deliver and filter ambient air 162 that is drawn into the hose 100 by the blower 92 and the ventilation assembly 80. In such an embodiment, the ambient air 172 is drawn into the drum 18 to remove the foreign substrate 94. It is also contemplated that the first filter 84 can be used to filter process air 156 that is moved through the airflow path 160 and into the drum 18.

The force with which the blower 92 projects the airflow into the interior cavity 52 within the drum 18 assists in directing the airflow within the interior cavity 52. The suction generated by the external receiving container 98 redirects the airflow toward the second filter 86. This circulation of airflow within the drum 18 assists in removing the foreign substrates 94 from the clothing items 96 disposed within the interior cavity 52. As the ventilation assembly 80 is in operation, the drum 18 is simultaneously tumbling the clothing items 96 within the interior cavity 52. The combination of tumbling to agitate and rearrange the clothing items, in combination with the operation of the ventilation assembly 80 to direct process air 156 toward the clothing assists in loosening the foreign substrates 94 from the clothing items 96 and directing the collected foreign substrates 94 within the foreign substrate collector 88.

Referring still to FIGS. 1-4, the blower 92 is configured to direct the process air 156 through the airflow path 160 and into the drum 18. The foreign substrate collector 88 can be operably coupled to a rear portion 102 of the drum 18. In this configuration, the barrier layer 16 of the door 14 is free from the first and second filters 84, 86, as the particles of foreign substrates 94 are collected by the foreign substrate collector 88. The blower 92 can be positioned at an upper portion 104 of the cabinet 12, such that the process air 156 is directed downward into the drum 18. The force of the moving process air 156 assists in releasing the foreign substrates 94 from the clothing items 96, and the direction of the flow of process air 156 circulates the foreign substrates 94 toward the foreign substrate collector 88.

With reference to FIGS. 1 and 5-7 and as described further below, the combination of the ventilation assembly 80 and the tumbling of the clothing items 96 within the drum 18 typically correspond to the user selecting a pre-wash cycle 110. The user can utilize the user interface 42 to one of a variety of routines 112 including, but not limited to, the pre-wash cycle 110, described below. The user interface 42 can include a knob 114 configured for at least partial operation of a cycle of the laundry appliance 10. The user interface 42 also includes a display screen 116 that displays the variety of routines 112 that a user may select. The routines 112 are executed by the controller 118 upon selection of one of the routines 112 by the user. The routines 112, described in more detail below, include a variety of cycle options including, but are not limited to, regular cycle 120, pet cycle 122, and the pre-wash cycle 110.

The pre-wash cycle 110 and the pet cycle 122 may include similar routine options, such that the pre-wash cycle 110 may appear if the user selects the pet cycle 122 option. For example, the user may select the pet cycle 122 option from the user interface 42, and the controller 118 will present the user with additional selection options via the user interface 42, referred to as pet cycle routines 124. The pet cycle routines 124 will be described in more detail below, but as an example, the user may select the pre-wash cycle 110 from the presented pet cycle routines 124 presented on the user interface 42, and the controller 118 will execute the pre-wash cycle 110. The pre-wash cycle 110 can be in the form of a pre-wash air cycle that includes an air tumble segment that utilizes projected streams of process air 156 into the interior cavity 52 of the drum 18 to release foreign substrates 94 from the clothing and/or fabric items 96 disposed within the interior cavity 52.

Referring still to FIGS. 1 and 5-9, in this configuration, one of the pet cycle routines 124 can be configured to increase the wash fluid 26 level within the drum 18, a water routine 128, upon selection of the pet cycle routine 124. It is contemplated that the controller 118 may present the water routine 128 upon selection of the pet cycle routine 124. For example, the user can select the pet cycle routine 124 on the user interface 42 and the controller 118 executes the water routine 128. The water routine 128 results in an increase in the volume of wash fluid 26 that is disposed within the drum 18 while the clothing items 96 are tumbling within the drum 18. The laundry appliance 10 may also be configured with an algorithm that includes a tumble routine 130. The tumble routine 130 may also be presented by the controller 118 upon selection of the pet cycle routine 124. It is generally contemplated that the tumble routine 130 may alter the speed and time of the clothing items 96 tumbling in the drum 18.

Figure 8:
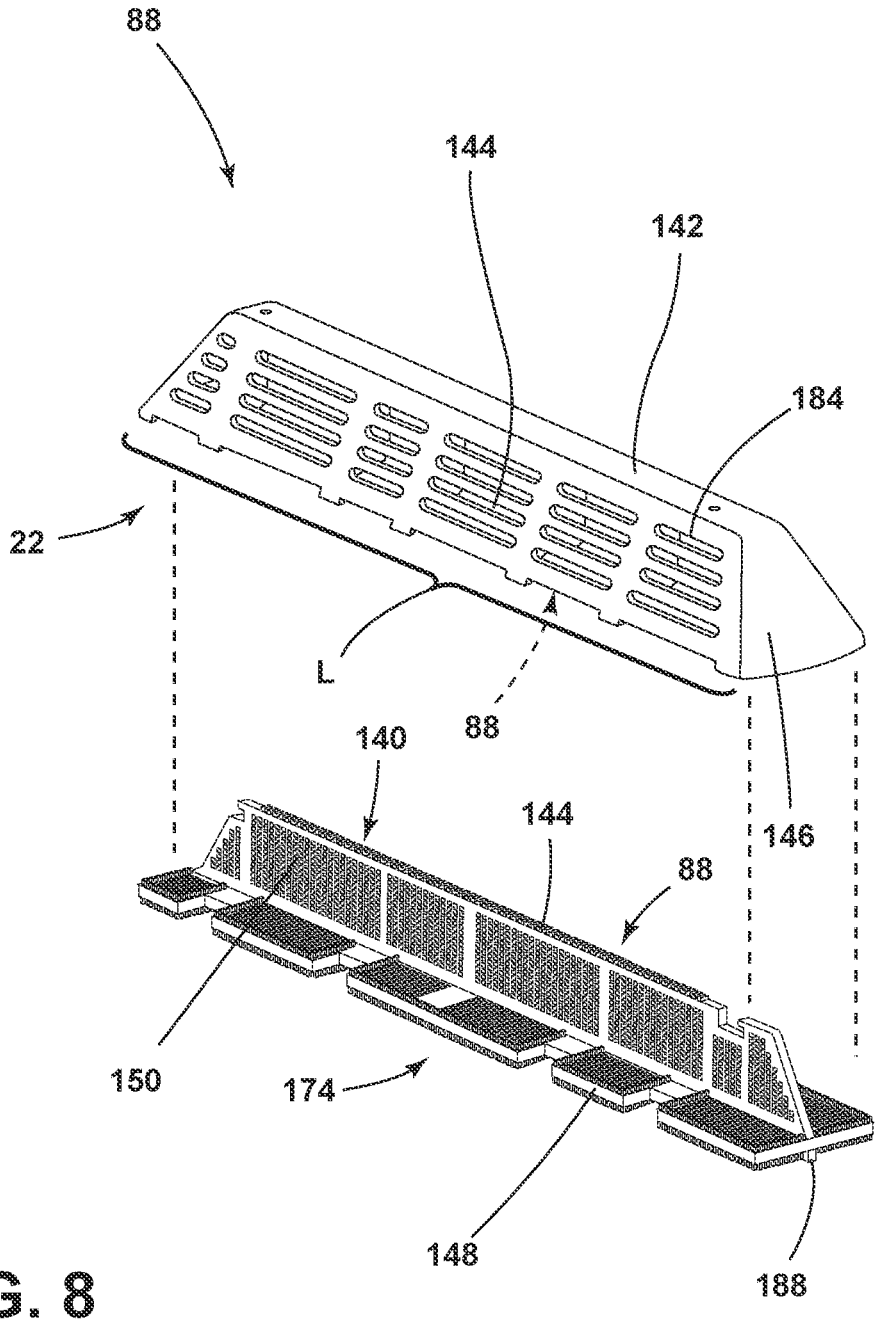
FIG. 8 is a top exploded perspective view of a foreign substrate collector of the present disclosure with a filter in phantom.
Figure 9:
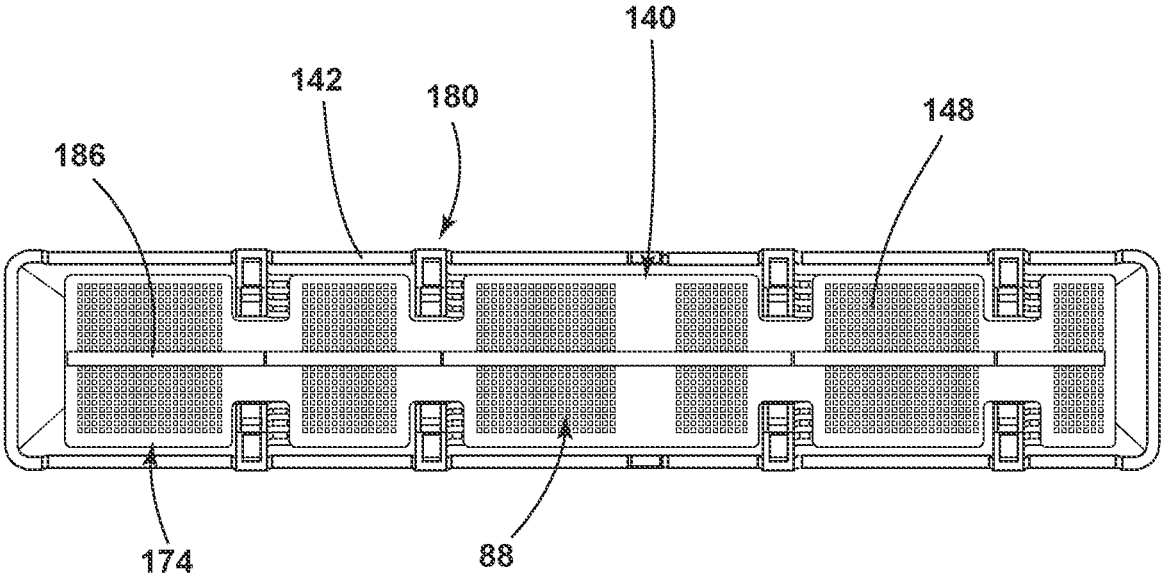
FIG. 9 is a bottom plan view of the foreign substrate collector of FIG. 8.

The increased volume of wash fluid 26 executed by the selection of the water routine 128 generally lifts the particles of foreign substrates 94 from the clothing items 96 to be collected by the foreign substrate collector 88. As illustrated in FIGS. 8 and 9, the foreign substrates 94 may be drawn into a mesh body 140 disposed within a housing 142 of the foreign substrate collector 88. By way of example, not limitation and as described herein, the foreign substrate collector 88 is integrally formed with the lifter 22 of the laundry appliance 10. The foreign substrates 94 are drawn through the housing 142 to the mesh body 140 by immersing the lifters 22 in the liquid simultaneously with the clothing items 96. As described herein, the lifter 22 may be a single lifter 22 that is integrally formed with the foreign substrate collector 88. Additionally or alternatively, the laundry appliance 10 may include a plurality of lifters 22 each integrally formed with a foreign substrate collector 88. Stated differently, the foreign substrate collector(s) 88 are submerged in the increased liquid volume at the same time as the clothing items 96 are submerged. Thus, any released foreign substrates 94 can be collected by the mesh body 140 of the foreign substrate collector 88. In certain aspects of the device, the lifter 22 having the foreign substrate collector 88 can be incorporated into a vertical axis appliance. In such an aspect, the level of the wash fluid 26 in the water routine 128 can be above the level of the lifter 22. Accordingly, the lifters 22 and the foreign substrate collectors 88 are able to move continuously through the wash fluid 26 to capture the foreign substrates 94. In this configuration, the wash fluid 26 is filled within the drum 18 to a first level during a standard wash cycle. During the water routine 128, typically performed during a pet cycle 122, the wash fluid 26 is filled to a second level that is higher than the first level.

With further reference to FIGS. 1 and 5-9, it is also contemplated that by increasing the tumbling time of the clothing items 96 within the drum 18 that more foreign substrates 94 can be collected. For example, the longer the tumble routine 130 of the pet cycle routine 124, the more contact the clothing items 96 typically have with the housing 142 of the foreign substrate collector 88. It is generally contemplated that the incorporated algorithms including the water routine 128 and the tumble routine 130 are incorporated when the laundry appliance 10 is a vertical-axis laundry appliance. As mentioned above, the lifter 22 disposed within the illustrated laundry appliance 10 can be integrally formed with the foreign substrate collector 88.

The lifter 22 includes the housing 142, which may also be referred to as an outer casing. The housing 142 defines a filter space 134 therein and within which the foreign substrate collector 88 is disposed. The housing 142 generally defines a plurality of slots 144 along a length L of the housing 142, which allows the foreign substrates 94 to pass through the housing 142. The foreign substrate collector 88 is illustrated as with the mesh body 140, which traps and retains the foreign substrates 94 that pass through the plurality of slots 144. It is generally contemplated that the mesh body 140 can be accessed via an end 146 of the housing 142 to remove the mesh body 140 for cleaning. The mesh body 140 includes a mesh base 148 and a mesh wall 150. Thus, the foreign substrates 94 are allowed to pass through the plurality of slots 144 and be retained within either or both of the mesh base 148 and the mesh wall 150.

Referring still to FIGS. 1 and 5-9, the increased number of interactions between the clothing items 96 and the foreign substrate collector 88 further directs the foreign substrates 94 into the plurality of slots 144 to be retained by the mesh body 140. It is advantageous for the laundry appliance 10 to incorporate either or both of these options during the routine to lift the foreign substrates 94 from the clothing items 96. Accordingly, the user may be prompted to make a selection on the user interface 42 as to whether both the water routine 128 and the tumble routine 130 are to be executed. Additionally or alternatively, it is also contemplated that the mere selection of the pet cycle 122 can execute both the increase in liquid volume and the increased speed and/or time of the tumble routine 130.

Figure 6:
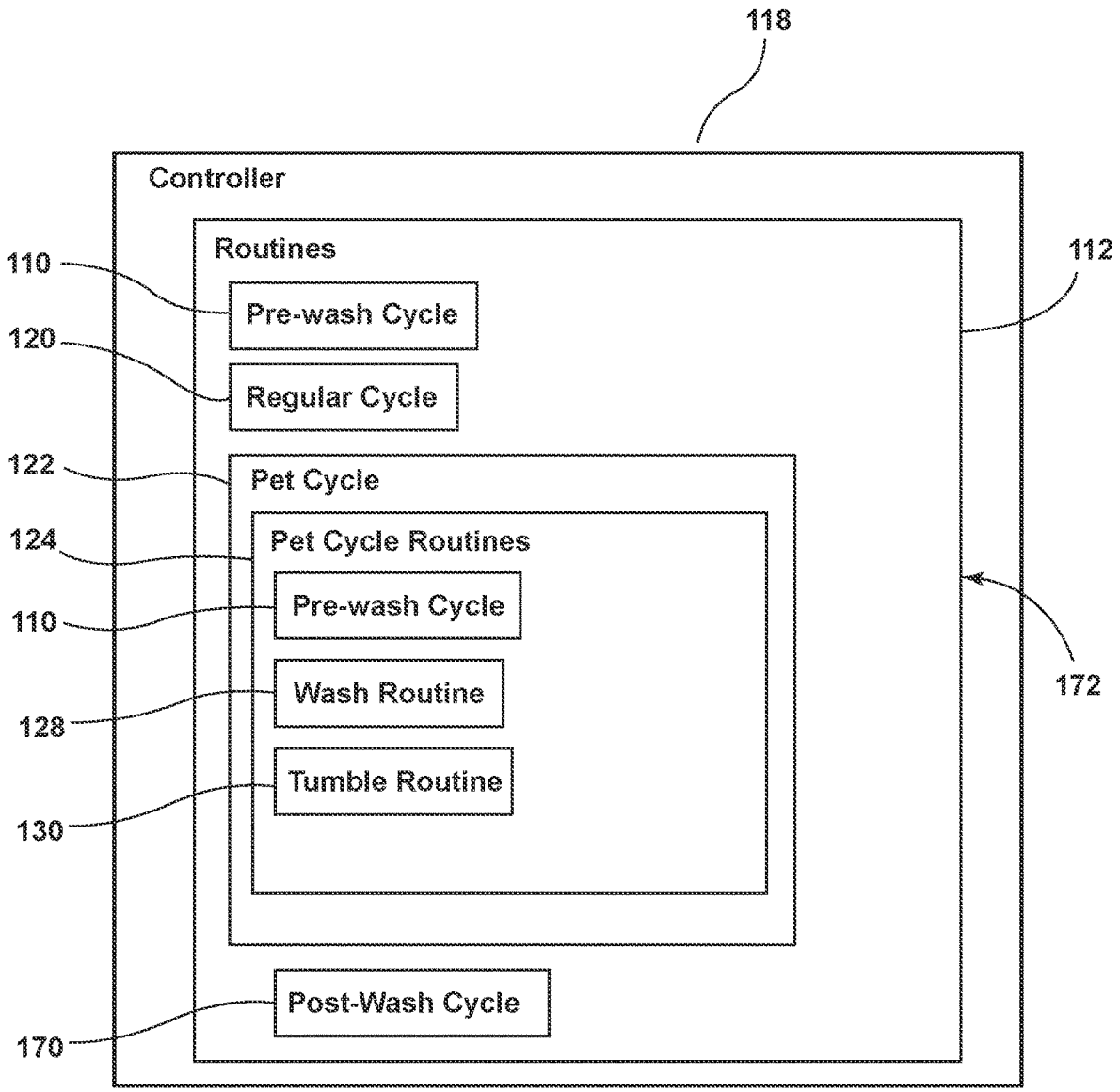
FIG. 6 is a schematic diagram of a controller that is programmed for operating a variety of routines including a pet cycle of the present disclosure.
Figure 7:
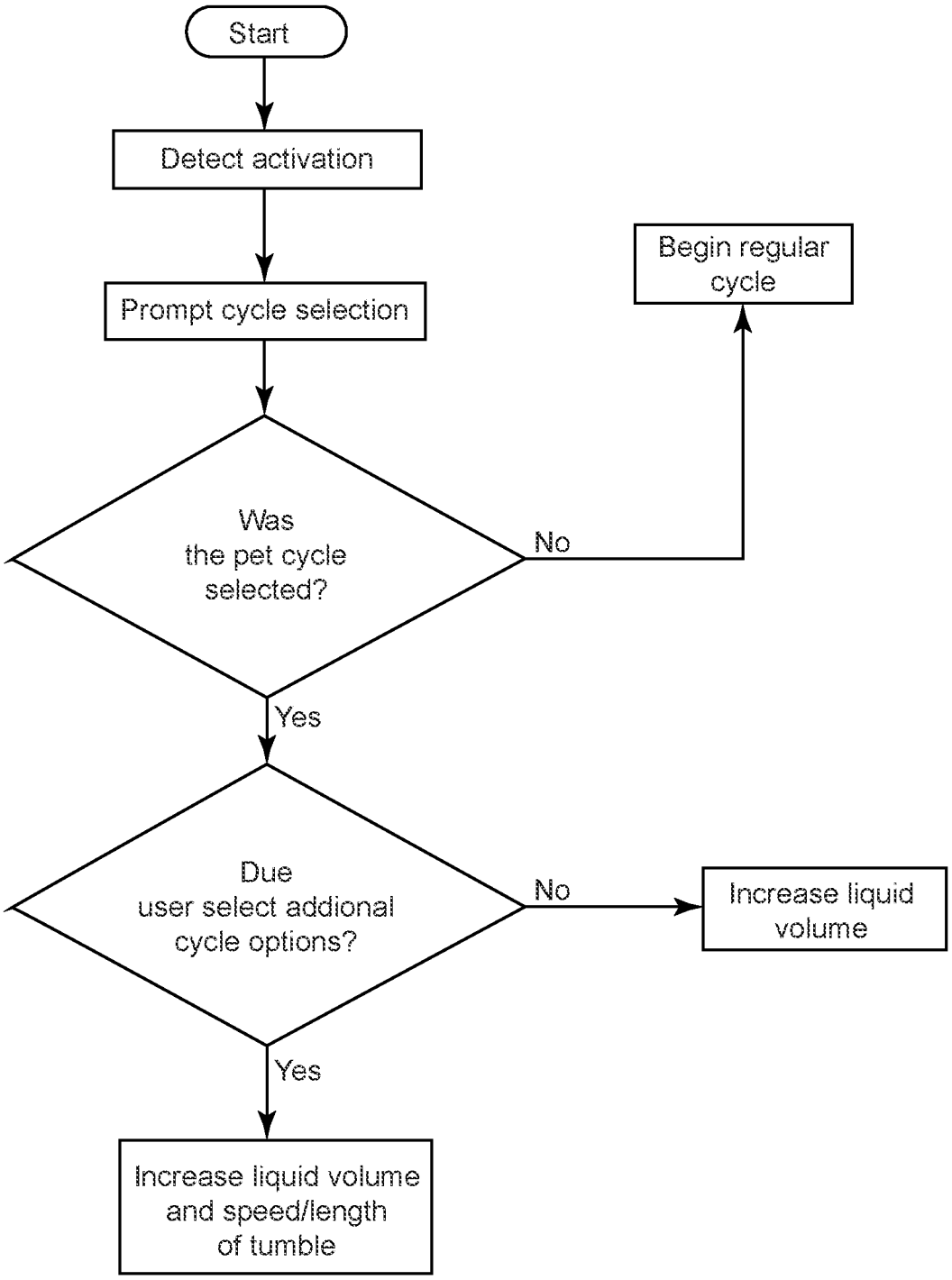
FIG. 7 is a schematic diagram of a water routine of a pet cycle of the present disclosure.

As schematically set forth in FIG. 6, it is generally contemplated that the pet cycle routine 124 may also include a post-wash cycle 170 configured to operate after the clothing items 96 have been removed from the drum 18. The controller 118 may detect the end of a wash cycle 172 after the pet cycle routine 124 has been operated and can display on the user interface 42 the option for the post-wash cycle 170. The post-wash cycle 170 is configured to remove remaining foreign substrates 94 within the drum 18 via the lifters 22. Specifically, the post-wash cycle 170 may run a low level of water within the drum 18 and remove any potential remaining foreign substrates 94 within the drum 18. The foreign substrates 94 are collected by filters 174 disposed within the lifters 22, similar to the mesh body 140 mentioned above, and can be removed for cleaning after the post-wash cycle 170.

It is also contemplated that the post-wash cycle 170 may also include recirculating the wash fluid 26 through the drum 18 via the pump 20. The pump 20 may be operably coupled to a basin 176, such as a sump of a tub 24, or a separate container that collects the wash fluid 26 after the pet cycle 122 is complete. Upon selection of the post-wash cycle 170, the collected wash fluid 26 will be pumped from the basin 176 via the pump 20 to circulate within the drum 18. During circulation within the drum 18, any potential remaining foreign substrates 94 can be collected by the foreign substrate collector 88 integrally formed with one of the lifters 22.

As illustrated in FIGS. 8-38, a variety of configurations of the foreign substrate collector 88 are depicted and will be described herein. It is generally contemplated that the foreign substrate collectors 88 described with respect to FIGS. 8-34 are integrally formed with at least one of the lifters 22 disposed within the drum 18. The foreign substrate collector 88, as mentioned above, includes the housing 142, which can define the plurality of slots 144 along the housing 142 of the foreign substrate collector 88.

Figure 10:
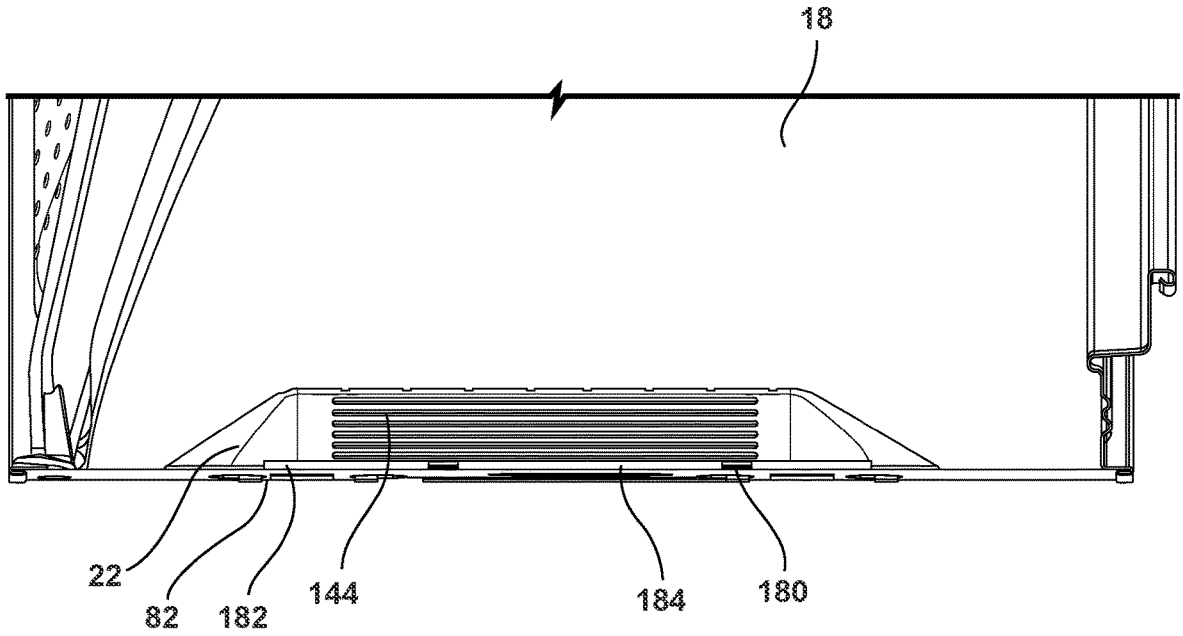
FIG. 10 is a partial cross-sectional view of a drum illustrating a foreign substrate collector of the present disclosure operably coupled to the drum.
Figure 11:
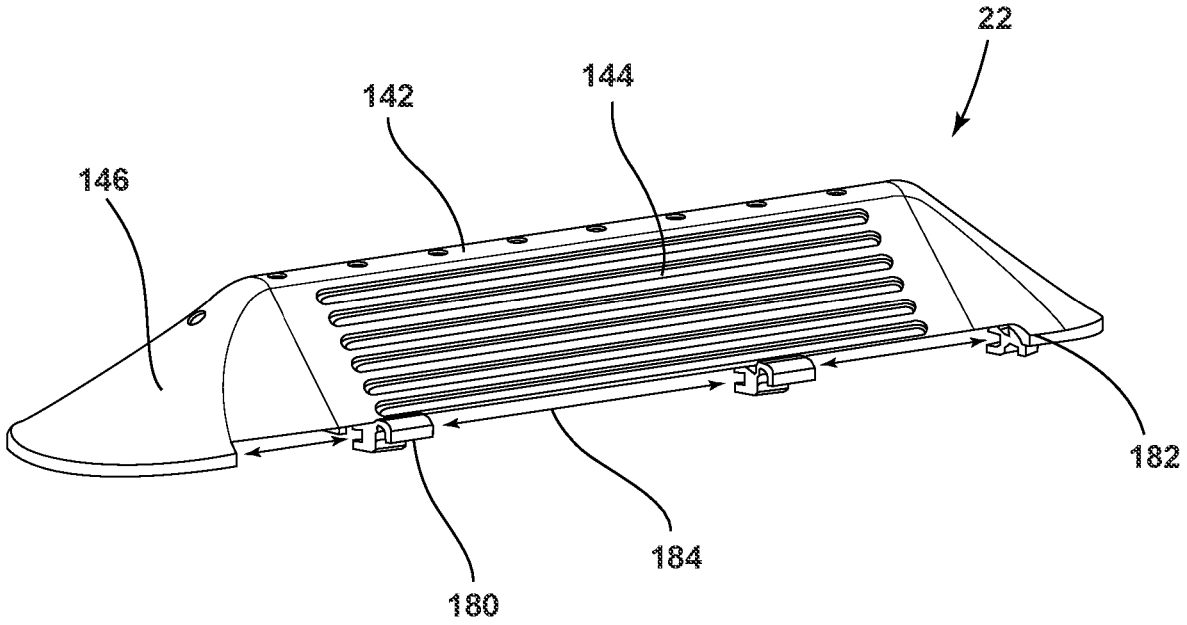
FIG. 11 is a top perspective view of the foreign substrate collector of FIG. 10, shown separated from the drum.

As illustrated in FIGS. 10 and 11, the housing 142 may include a plurality of attachment features 180 disposed on an attachment portion 182 of the housing 142. The drum 18 may define the plurality of apertures 82 through which the attachment features 180 of the housing 142 may extend to operably couple the lifter 22 to the drum 18.

Referring to FIGS. 1, and 8-11, the lifter 22 may define openings 184 between each of the attachment features 180, such that the lifter 22 is at least partially raised relative to the drum 18. It is generally contemplated that, in this configuration, the foreign substrates 94 released within the drum 18 may pass through the openings 184 defined by the lifter 22 between the lifter 22 and the drum 18. The foreign substrate collector 88 may be formed from, but is not limited to, the filter 174 and a support 188. The foreign substrate collector 88 may include a single filter 174 and/or multiple filters 174 operably coupled to the support 188 within the housing 142.

Figure 12:
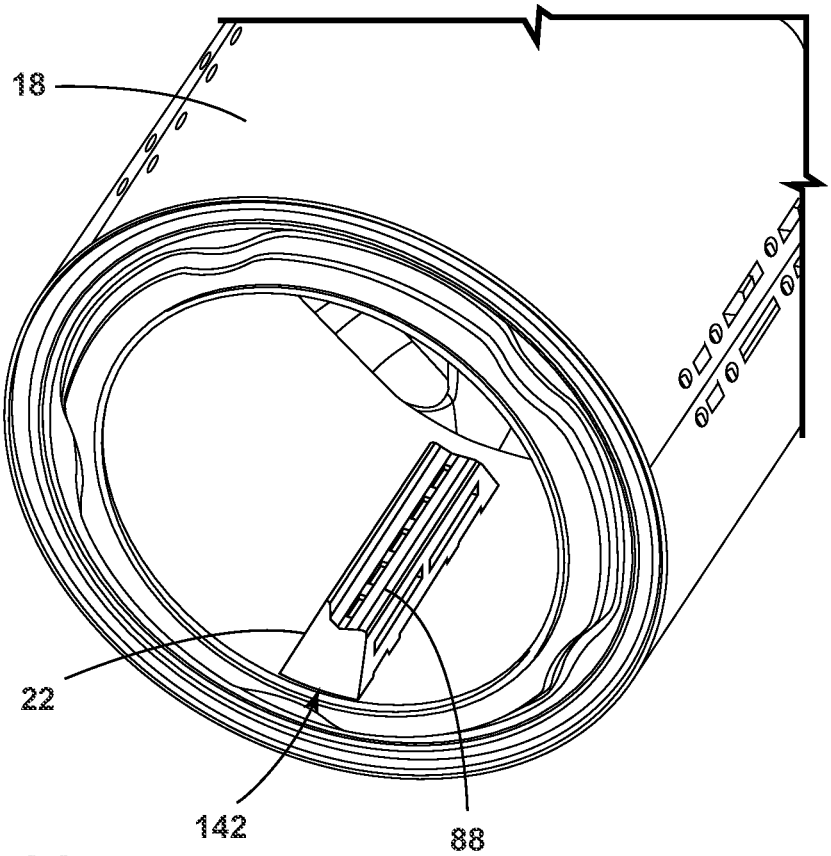
FIG. 12 is a side perspective view of a drum with a foreign substrate collector of the present disclosure.
Figure 13:
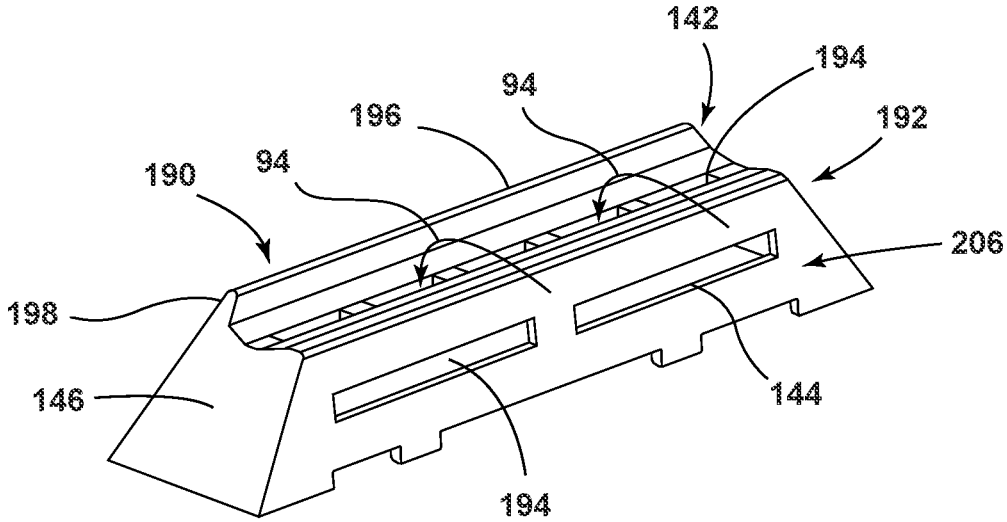
FIG. 13 is a top perspective view of the foreign substrate collector of FIG. 12, shown separated from the drum.
Figure 14:
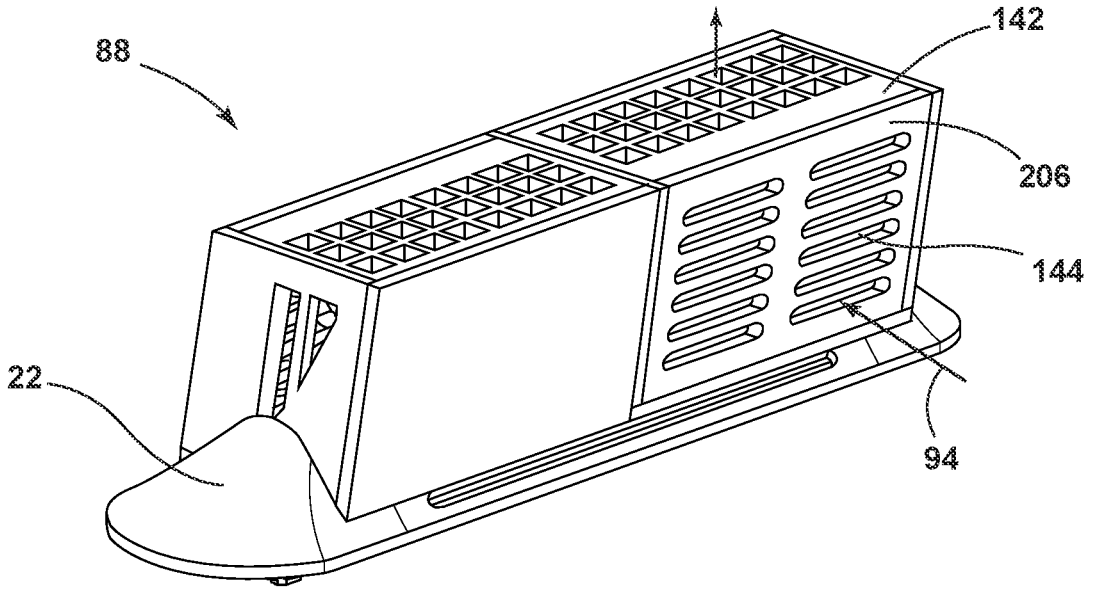
FIG. 14 is a top perspective view of a foreign substrate collector of the present disclosure coupled to a lifter.
Figure 15:
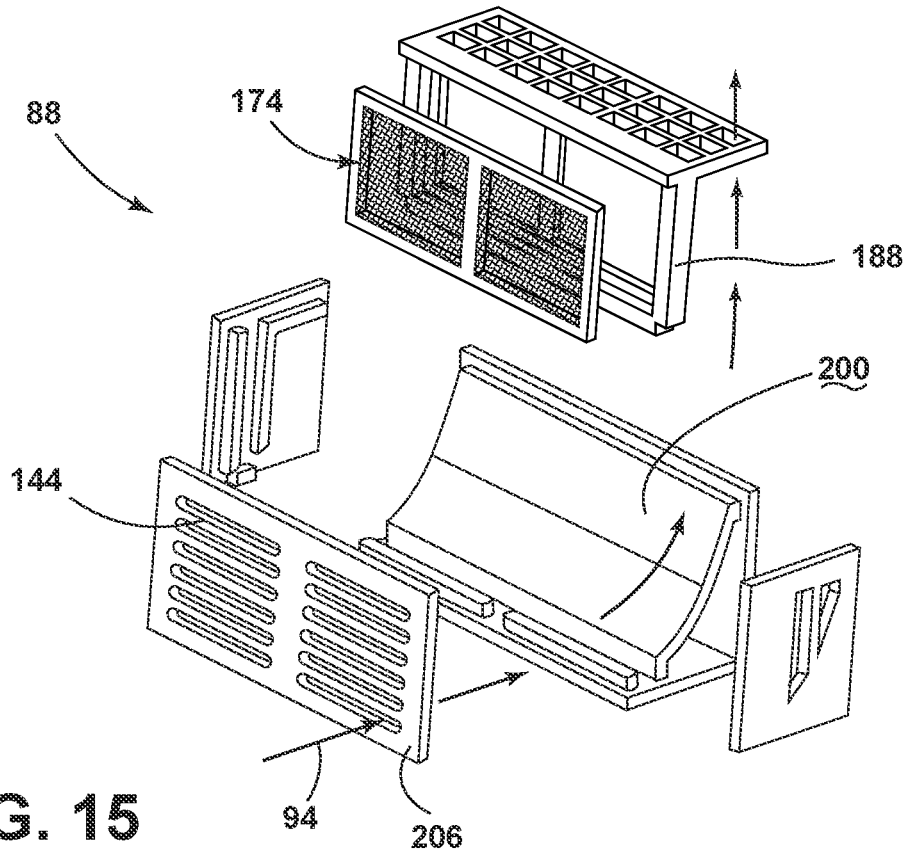
FIG. 15 is an exploded top perspective view of the foreign substrate collector of FIG. 14.
Figure 16:
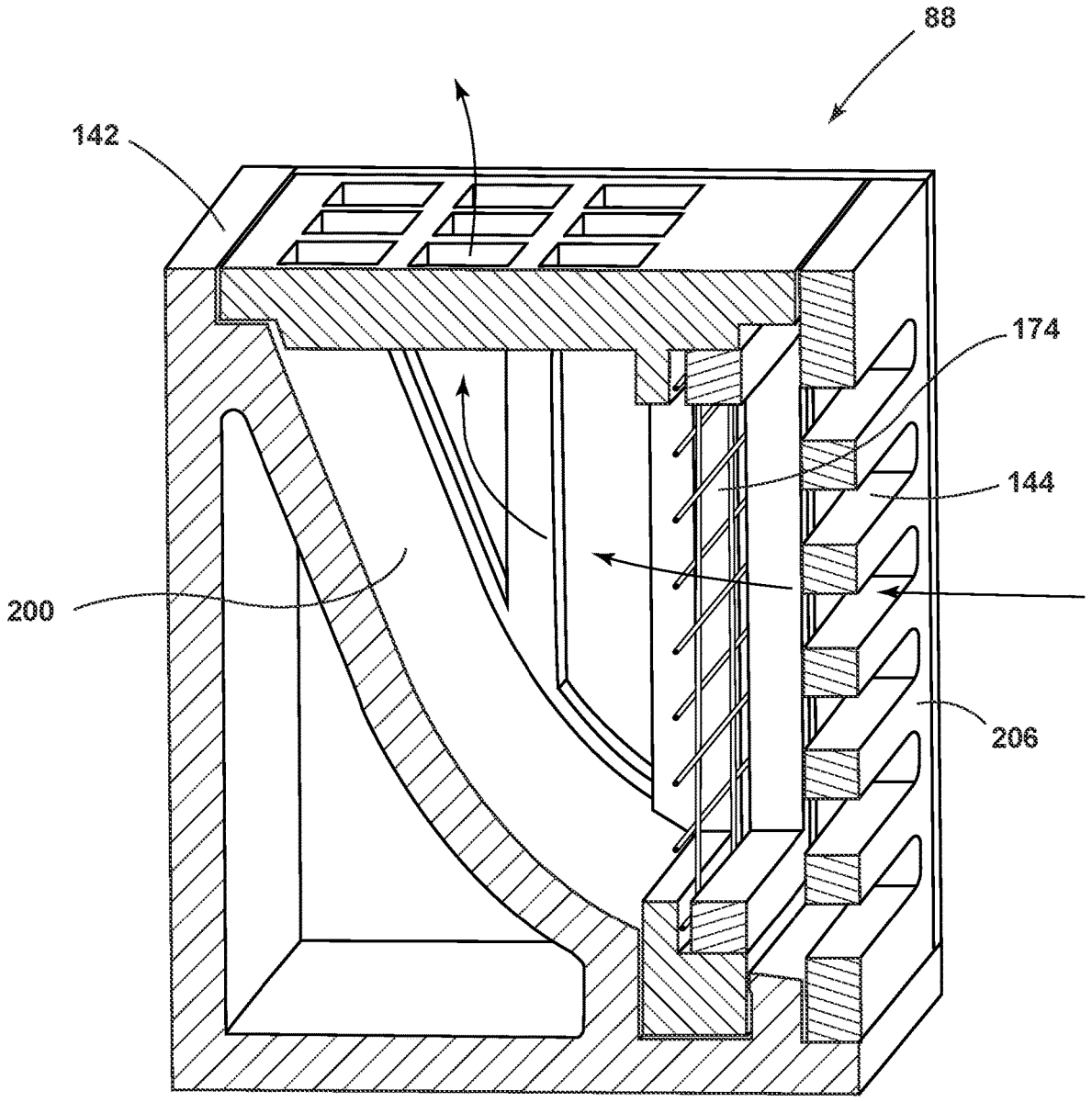
FIG. 16 is a cross-sectional view of the foreign substrate collector of FIG. 14.

Referring now to FIGS. 1, 12, and 13, the housing 142 of the lifter 22 may be configured as a multilayered housing 190, such that the housing 142 includes a plurality of layers 192 through which passages 194 are defined. Each of the plurality of layers 192 may be defined at various vertical heights, such that the plurality of passages 194 defined by each layer 192 may be generally misaligned to maximize the collection of and trapping of the foreign substrates 94. The variation of the heights of the plurality of layers 192 allows the lifter 22 to collect the foreign substrates 94 at varying water levels within the drum 18. The variable heights of the plurality of passages 194 maximizes the number of foreign substrates 94 that can be collected by the lifter 22 during various portions of the laundry cycle, regardless of whether the laundry cycle is the selected pet cycle routine 124.

The lifter 22 in this configuration also includes a diverter 196 positioned along a projected surface 198 of the lifter 22. The diverter 196 is configured to direct the foreign substrates 94 that may be floating within the liquid during the wash cycle and redirect the foreign substrates 94 into the lifter 22. The diverter 196 redirects the foreign substrates 94 into the housing 142 while redirecting the clothing items 96 within the drum 18.

Referring now to FIGS. 1 and 14-16, the housing 142 of the lifter 22 is illustrated as defining the plurality of slots 144 along at least one side 206 of the housing 142. In one configuration illustrated in FIG. 16, the lifter 22 includes a sloped surface 200 disposed within the housing 142 and including the filter 174 disposed along the sloped surface 200. The filter 174 is configured to collect the foreign substrates 94 that pass through the plurality of slots 144 defined by the housing 142 and as generally described above. The filter 174 may be operably coupled to an enclosure surface disposed along the housing 142 and operably coupled to the lifter 22. The user may remove the filter 174 from the housing 142 to remove any potential collected foreign substrates 94 on the filter 174. As the foreign substrates 94 enter into the slots 144, the foreign substrates 94 are captured within the filter 174. The material carrying the foreign substrates 94, whether in the form of a flow of wash fluid 26 or a flow of process air 156, is then directed by the sloped surface 200 within the filter space 134 back into the interior cavity 52 defined within the drum 18.

Figure 17:
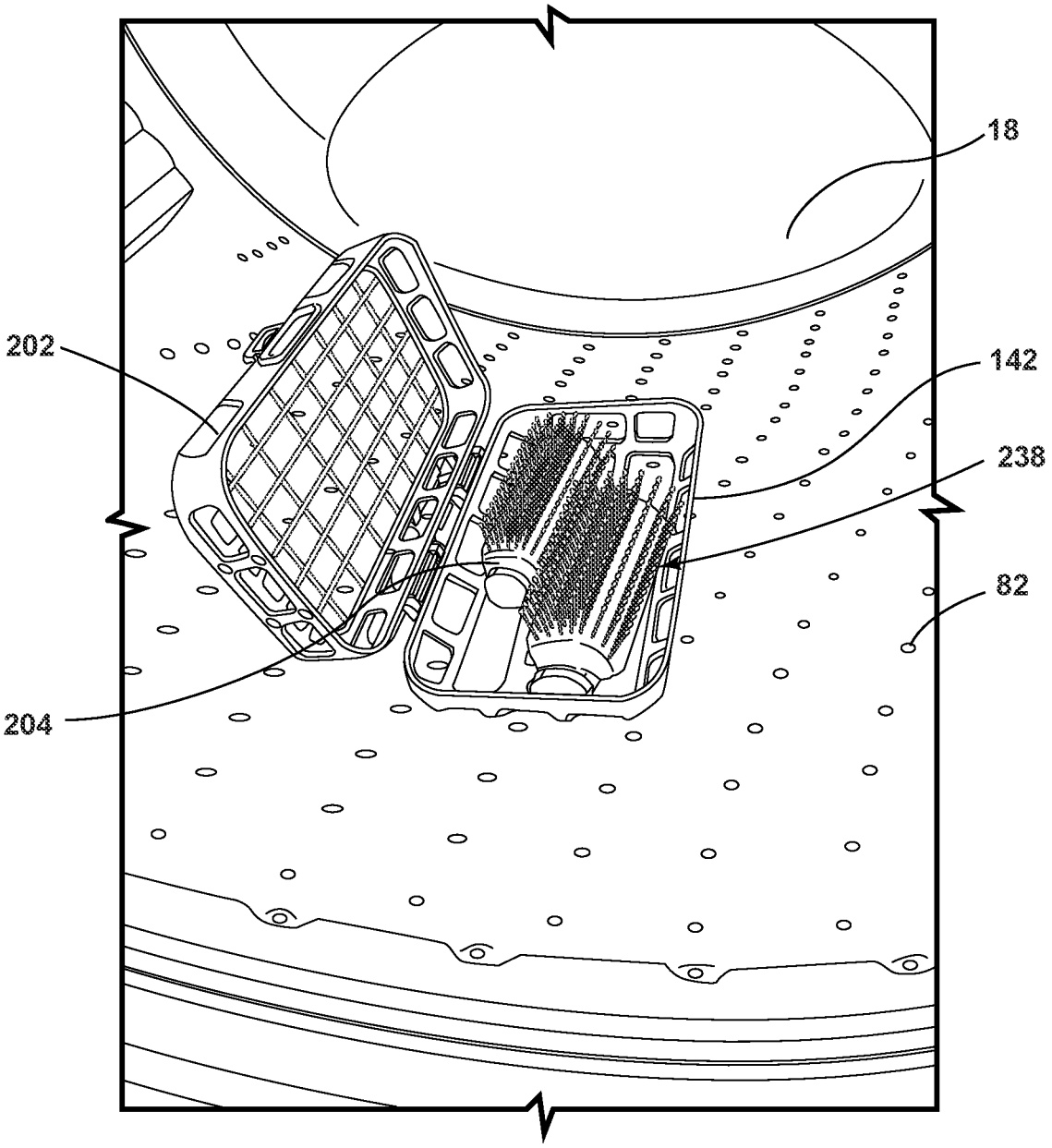
FIG. 17 is a partial top perspective view of a drum with a foreign substrate collector of the present disclosure, including a basket and a collection member.
Figure 18:
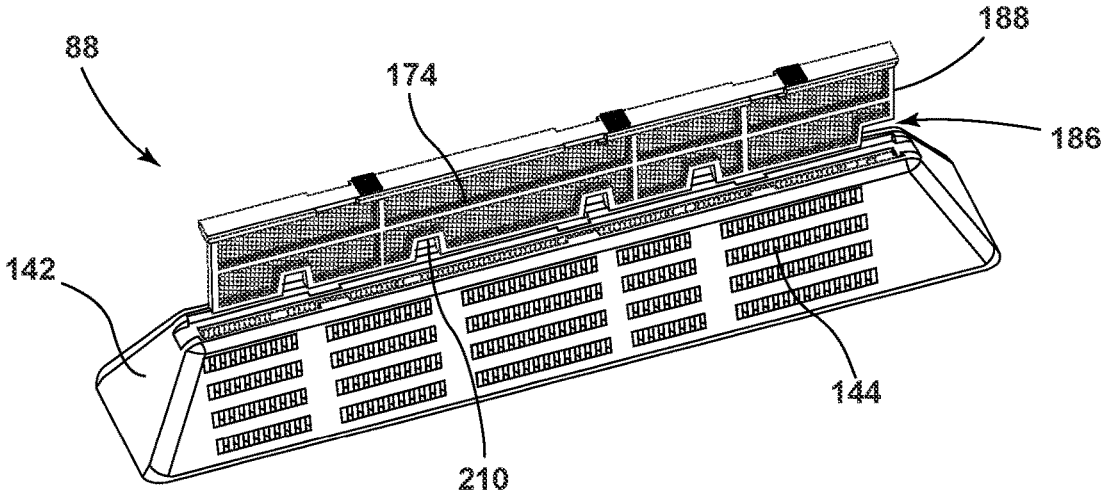
FIG. 18 is an exploded top perspective view of a foreign substrate collector of the present disclosure.
Figure 19:
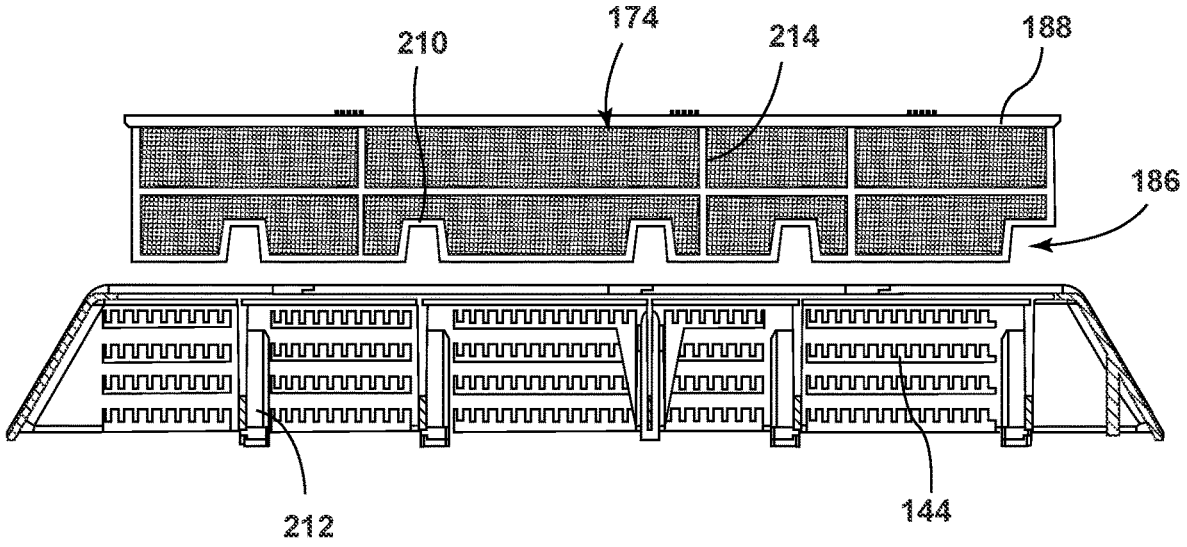
FIG. 19 is an exploded cross-sectional view of the foreign substrate collector of FIG. 18 with a frame for a filter.
Figure 20:
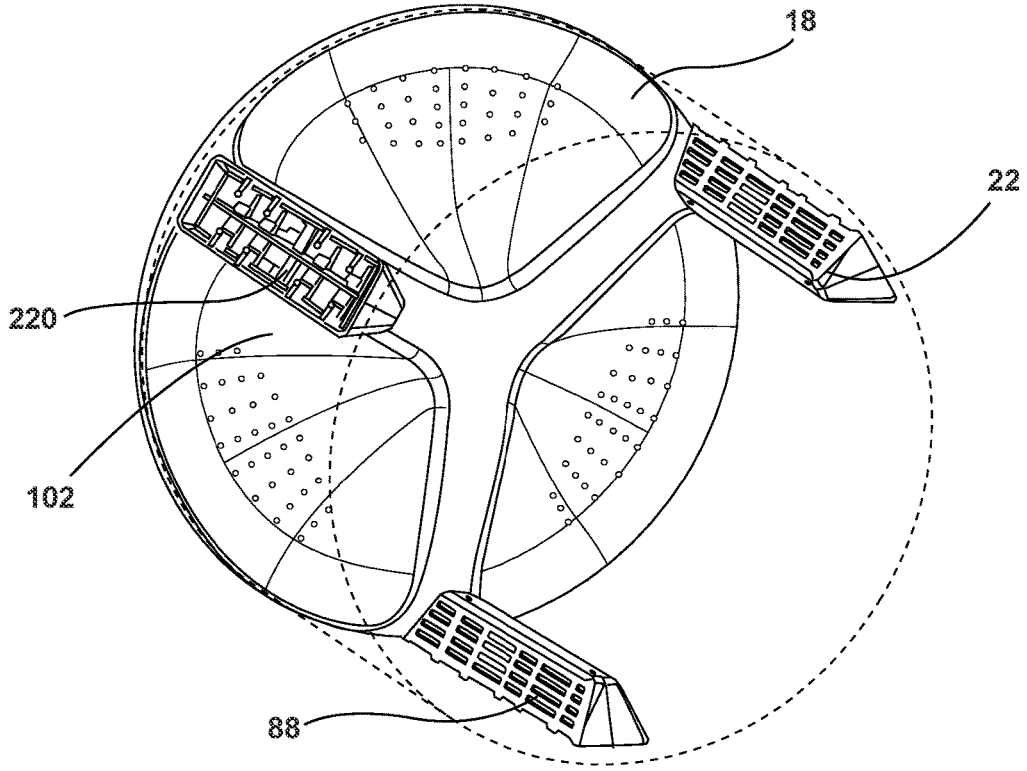
FIG. 20 is a top perspective view of a drum and a plurality of foreign substrate collectors of the present disclosure.
Figure 21:
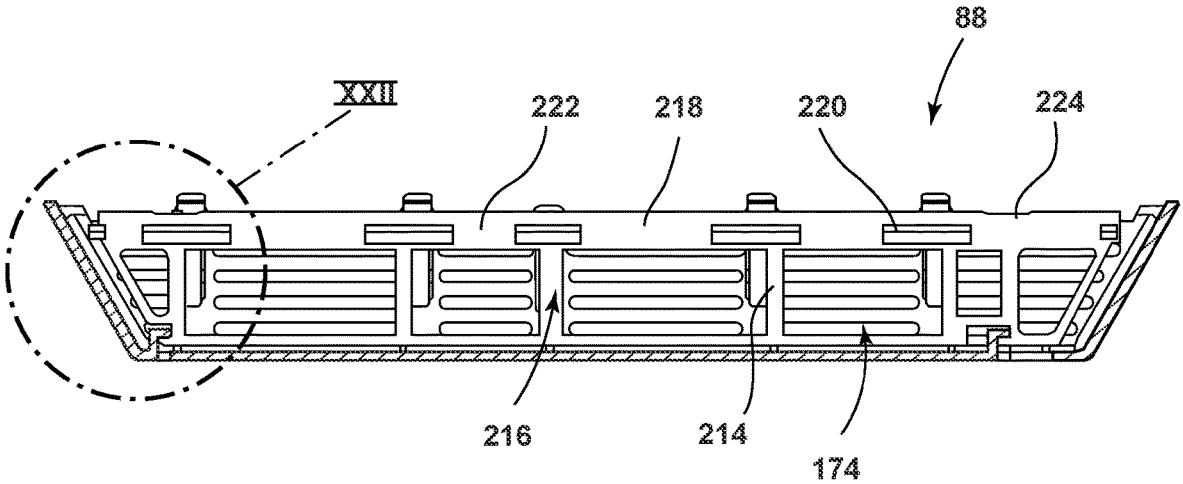
FIG. 21 is a cross-sectional view of one of the foreign substrate collectors of FIG. 20.
Figure 22:
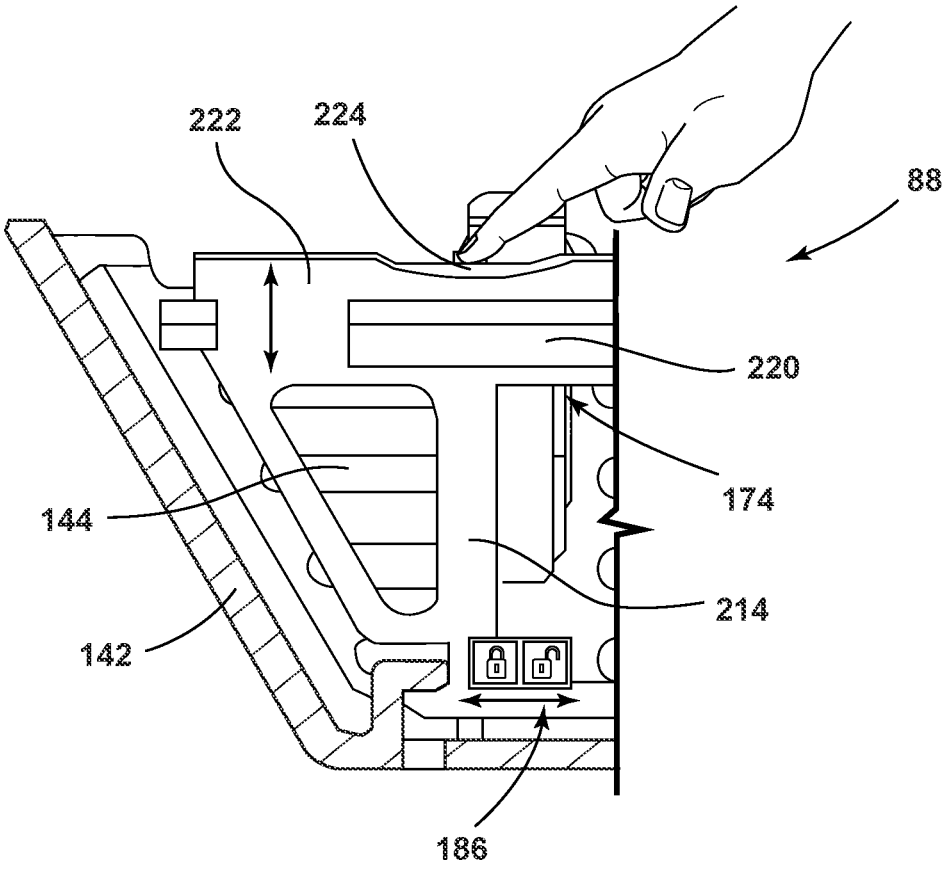
FIG. 22 is a partial cross-sectional view of the foreign substrate collector of FIG. 21 taken at area XXII.
Figure 23:
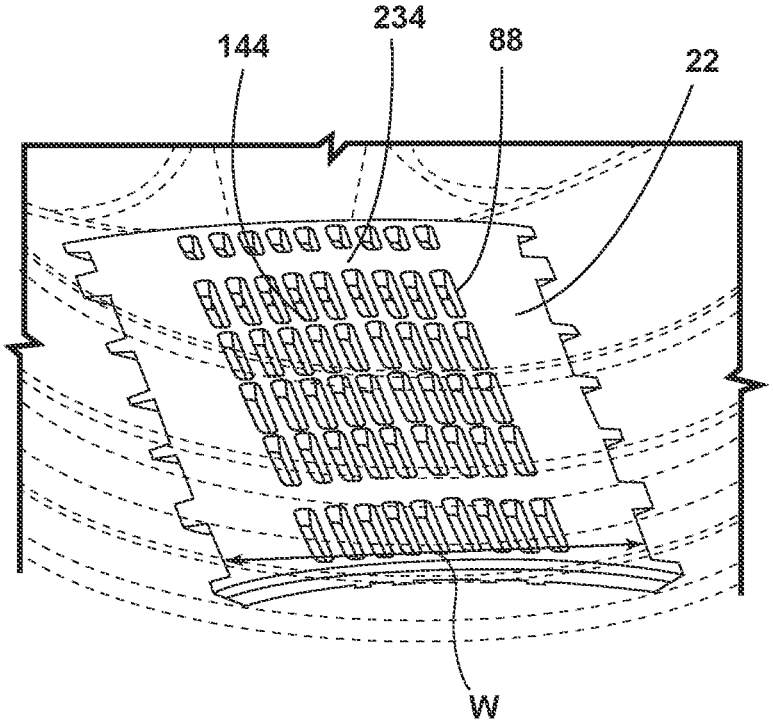
FIG. 23 is a partial top perspective view of a foreign substrate collector of the present disclosure and positioned within a drum.
Figure 24:
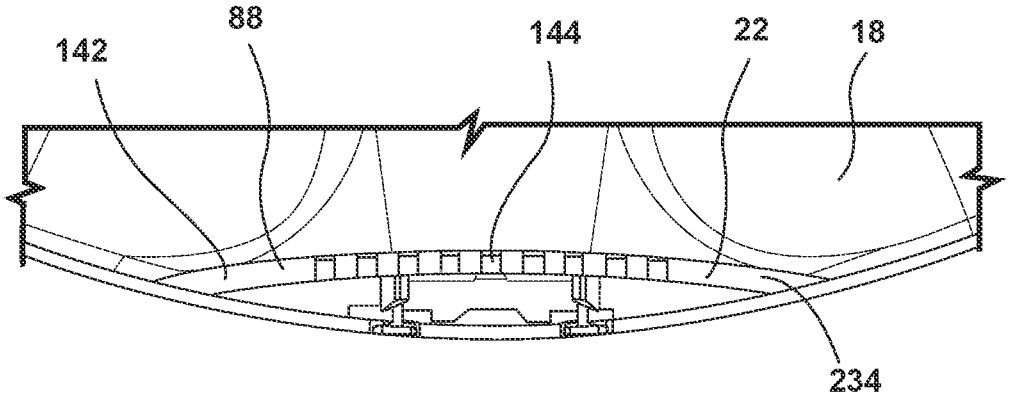
FIG. 24 is a cross-sectional view of the foreign substrate collector of FIG. 23.
Figure 25:
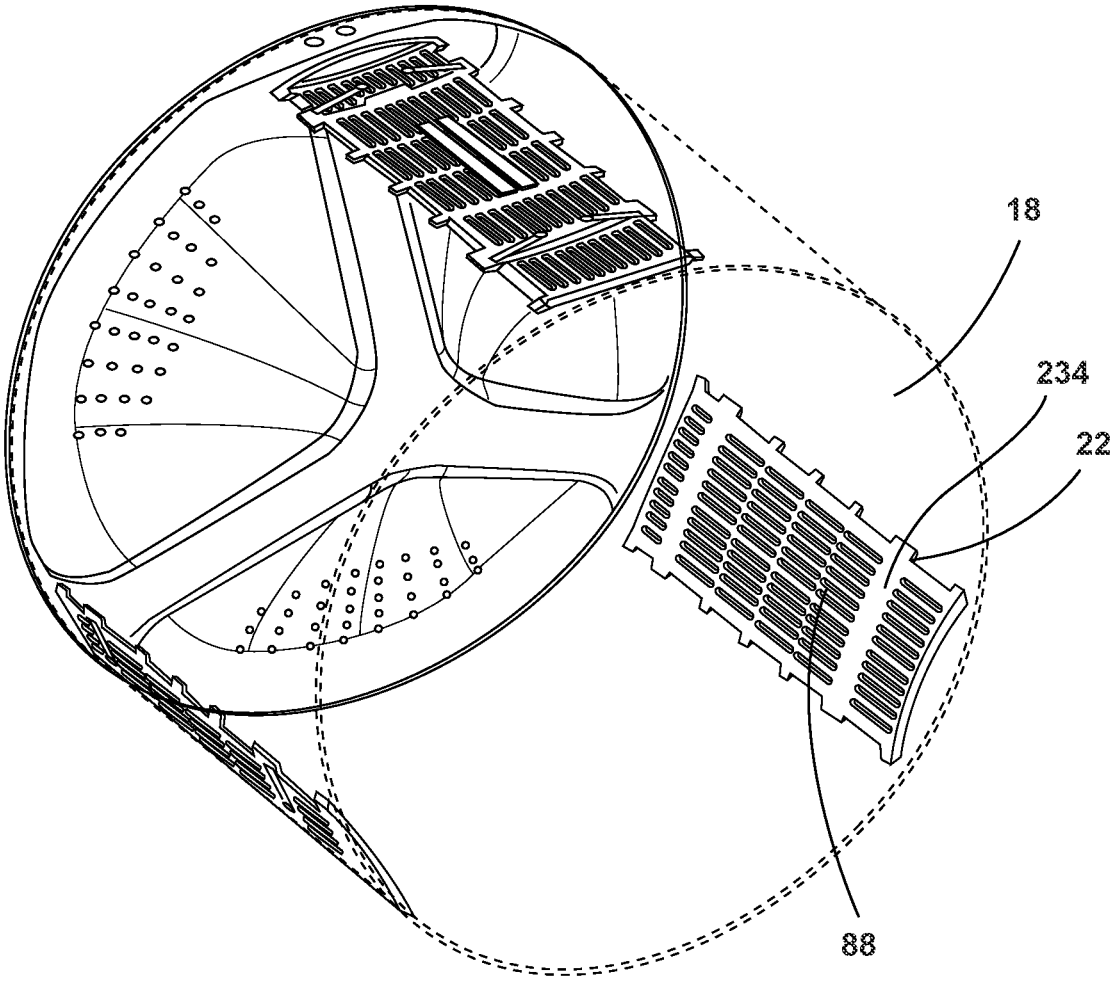
FIG. 25 is a top perspective view of a drum with a plurality of foreign substrate collectors of the present disclosure.
Figure 26:
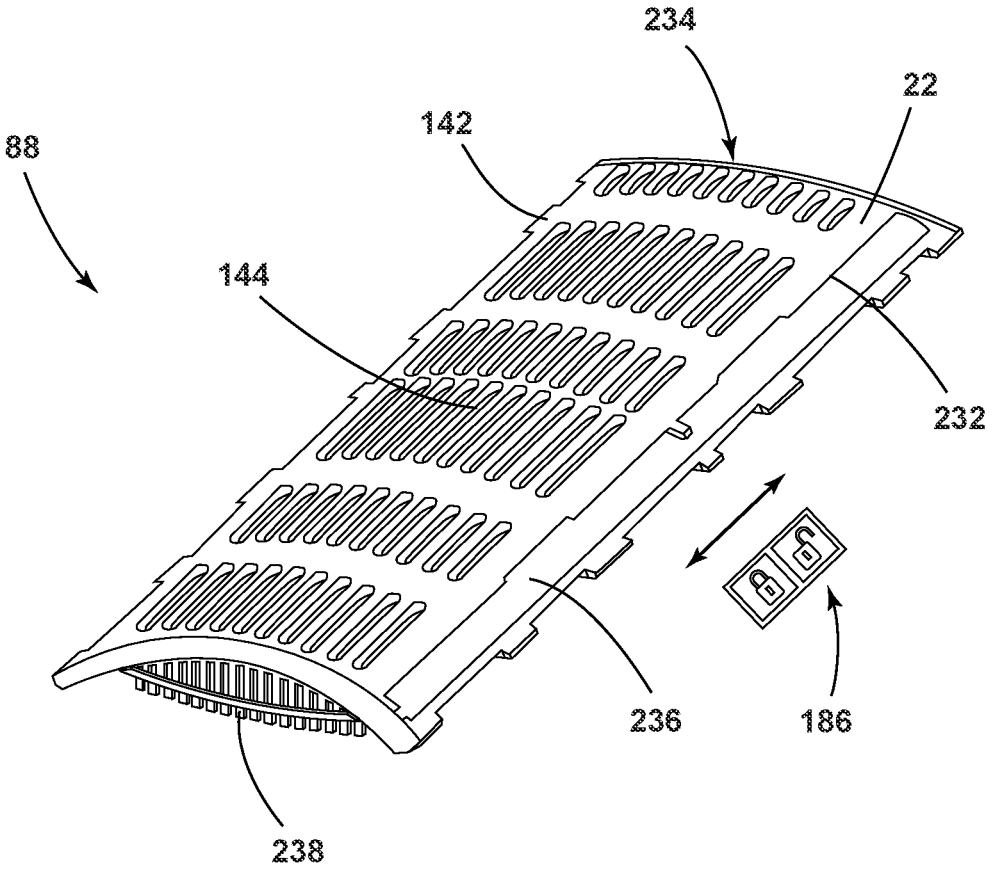
FIG. 26 is a top perspective view of a foreign substrate collector of the present disclosure.
Figure 27:
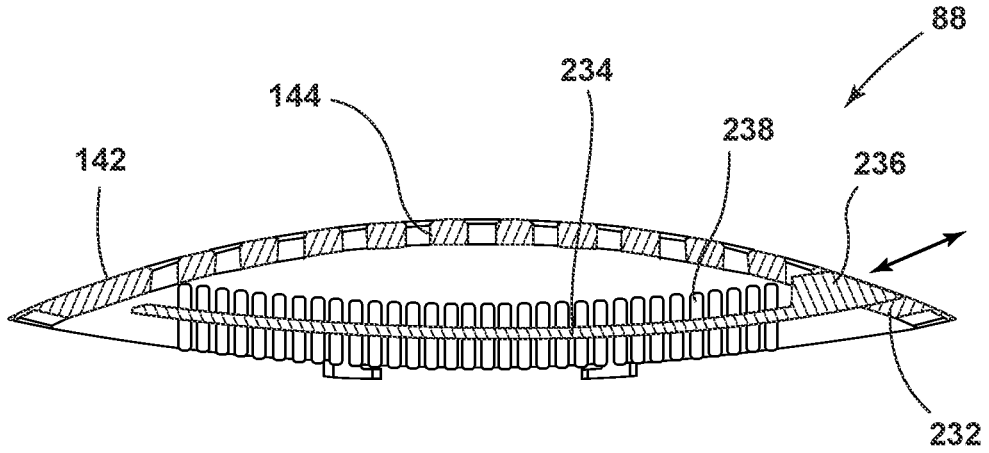
FIG. 27 is a cross-sectional view of the foreign substrate collector of FIG. 26 with a body and a plurality of bristles.
Figure 28:
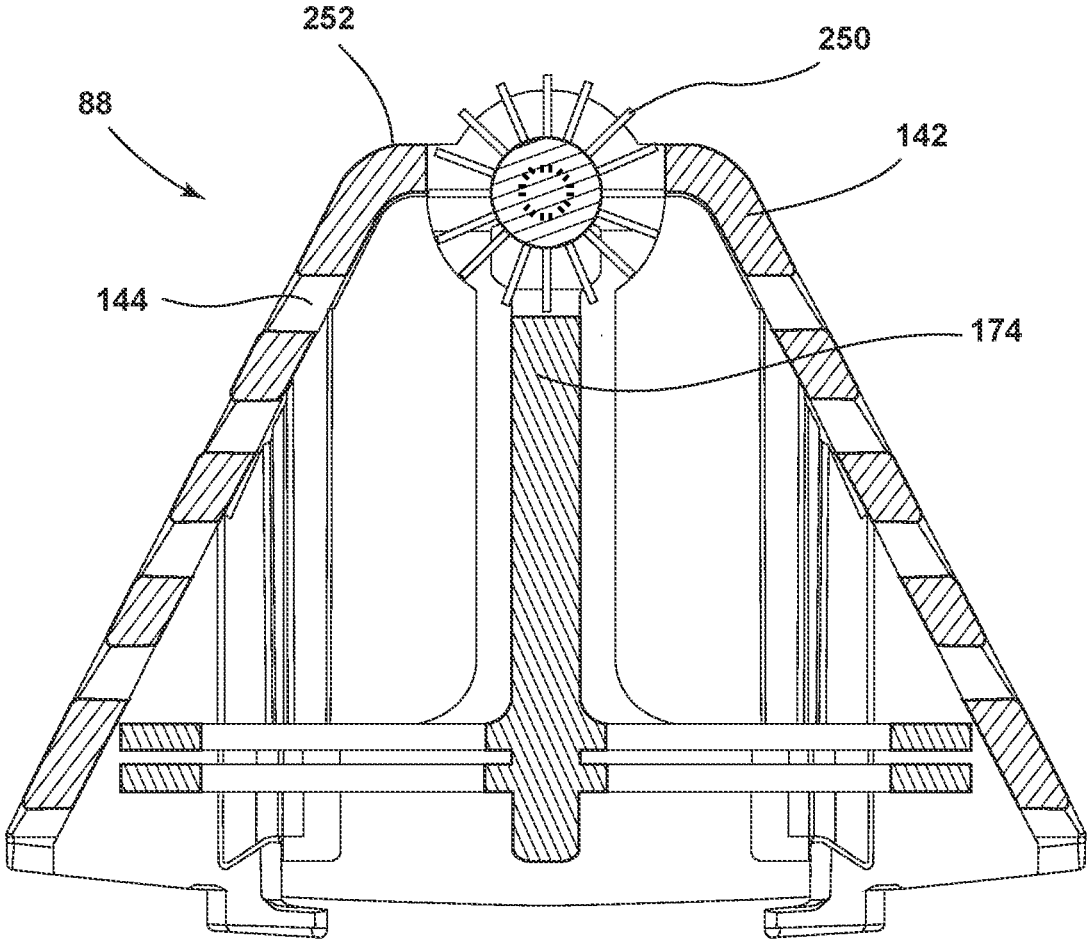
FIG. 28 is an enlarged cross-sectional view of a foreign substrate collector of the present disclosure with a brush.
Figure 29:
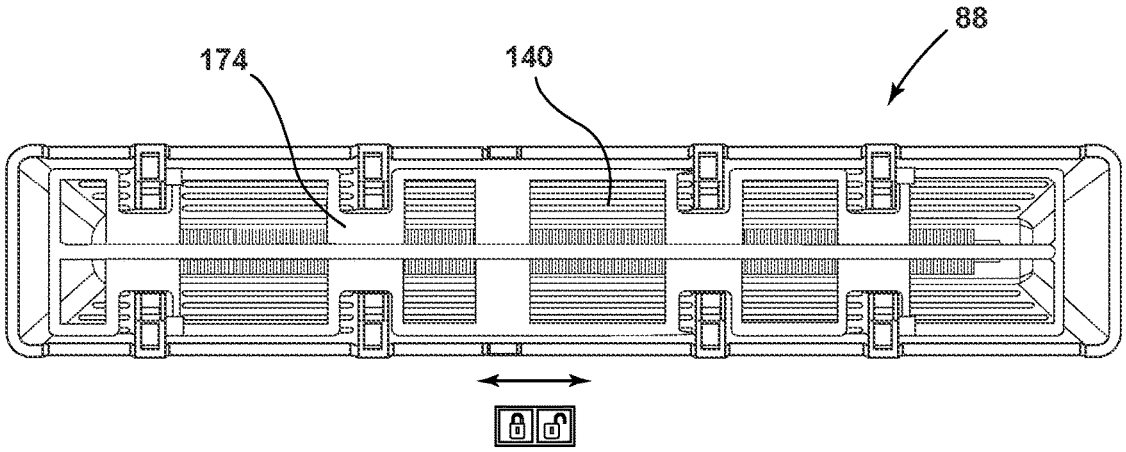
FIG. 29 is a bottom plan view of the foreign substrate collector of FIG. 28 with a filter and the brush.
Figure 30:
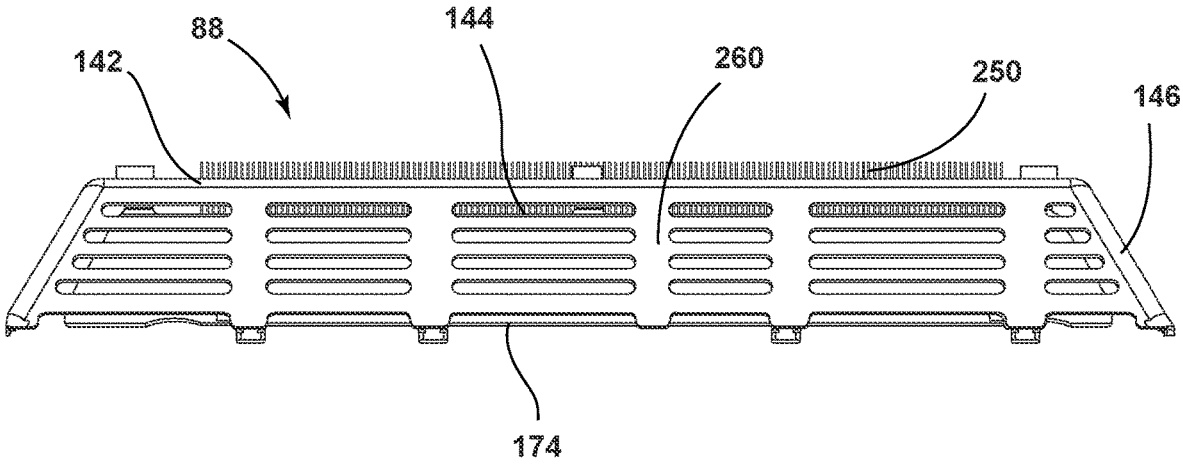
FIG. 30 is a side elevational view of the foreign substrate collector of FIG. 28.
Figure 31:
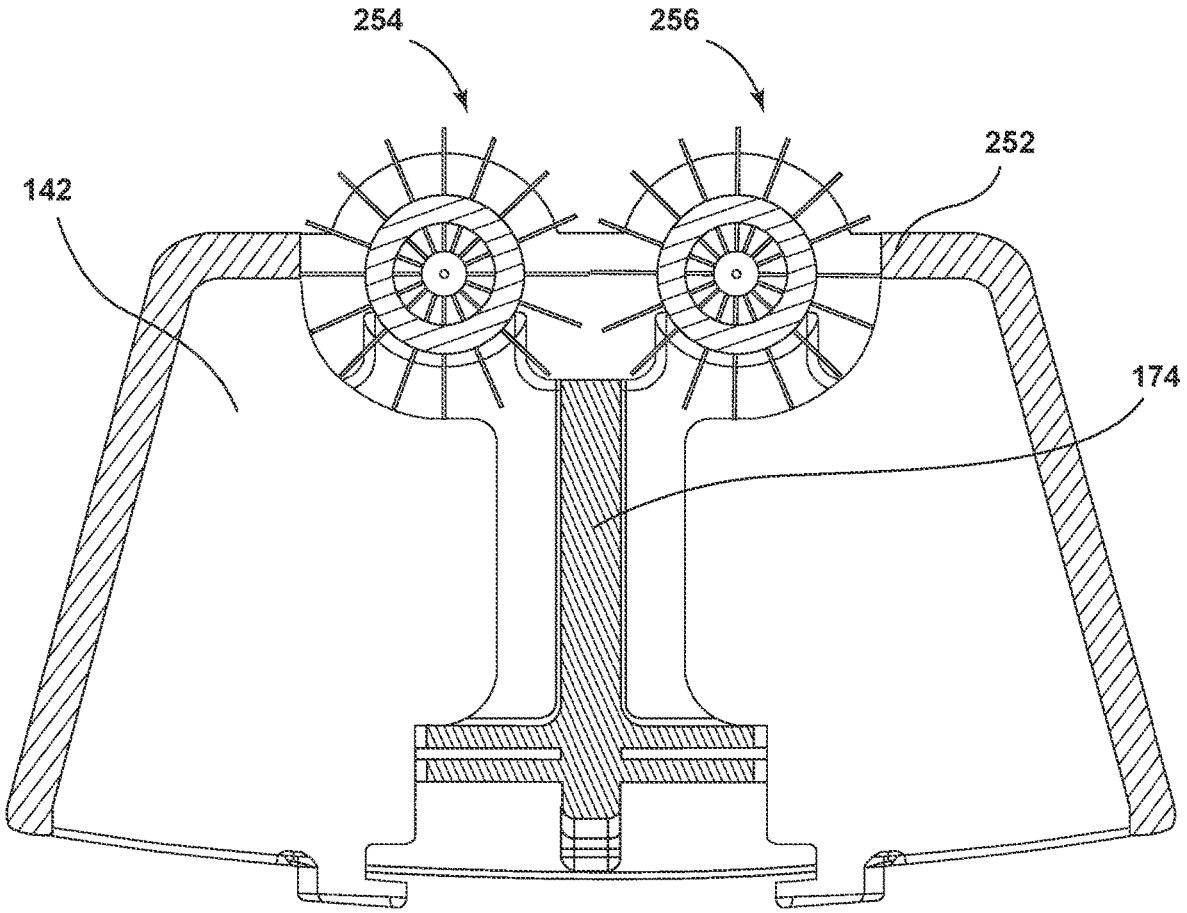
FIG. 31 is an enlarged cross-sectional view of a foreign substrate collector of the present disclosure with a first brush and a second brush.

In an alternate configuration illustrated in FIG. 17, the housing 142 of the foreign substrate collector 88 is illustrated as a basket 202. The basket 202 may hingedly open to provide the user access to remove the foreign substrates 94 from a collection member 204 disposed within the basket 202. It is generally contemplated that the collection member 204 may include a plurality of bristles 238 that extend from within the basket 202 to an area outside of the basket 202. In this manner, the plurality of bristles 238 at least partially engage the clothing items 96 within the interior cavity 52 of the drum 18. Additionally or alternatively, the collection member 204 may be concealed within the basket 202 to collect the foreign substrates 94 without engaging with the clothing items 96. The basket 202 provides for the material carrying the foreign substrates 94 to enter into the basket 202 and also flow around the basket 202 so that the plurality of bristles can capture the foreign substrates 94.

As mentioned above, the foreign substrate collector 88 includes the frame 188. The frame 188 illustrated in FIGS. 18-22 defines a plurality of recesses 210 configured to receive a plurality of projections 212 defined by the lifter 22. The frame 188 includes the filter 174 configured to collect the foreign substrate 94 as they pass through the plurality of slots 144 defined by the housing 142. The frame 188 may snap-fit and slide lock with the housing 142, such that the user can position the frame 188 within the lifter 22 and slide the frame 188 relative to the housing 142 to lock the frame 188 within the housing 142. The slide-lock 186 of the frame 188 of the filter 174 minimizes the potential for misalignment or removal of the frame 188 during operation of the laundry appliance 10.

With further reference to FIGS. 1 and 18-22, the frame 188 can also define vertical planes 214 along which the filter 174 may be disposed. The vertical planes 214 are defined by planar portions 216 that extend between an outer frame 218 of the frame 188 to define the portion of the frame 188 in which the filter 174 may be positioned. It is also contemplated that the frame 188 may include horizontal planes 220 similarly configured as the vertical planes 214 and extending from an elongated attachment portion 222 of the frame 188. It is also contemplated that the elongated attachment portion 222 from which the horizontal and vertical planes 220, 214 extend may define grooves 224. The user may apply pressure along the grooves 224 of the elongated attachment portion 222 as the frame 188 is being positioned within the housing 142 to engage the slide-lock 186 to secure the frame 188 within the housing 142.

Referring now to FIGS. 1 and 23-27, the lifter 22 is illustrated as having a greater width W, such that the lifter 22 has a generally crescent-shaped housing 142 disposed along an inner surface 230 of the drum 18. The foreign substrate collector 88 is selectively positioned within the housing 142. The foreign substrate collector 88 is selectively coupled to the housing 142 via a slit 232 defined by the housing 142. It is generally contemplated that the foreign substrate collector 88, as mentioned above, can slidably lock relative to the housing 142 to retain the foreign substrate collector 88 within the housing 142.

In this configuration, the foreign substrate collector 88 includes a body 234, a grasping portion 236, and a plurality of bristles 238 disposed along the body 234. The body 234 and the plurality of bristles 238 are configured to be disposed within the housing 142 and collect the foreign substrates 94 that pass through the plurality of slots 144 defined by the housing 142. In certain aspects of the device, a portion of the bristles 238 can extend outside of the housing 142 to collect foreign substrate 94 within a flow of the wash fluid 26 contained within the drum 18. The grasping portion 236 is operably coupled to the housing 142 via the slit 232 defined by the housing 142. The grasping portion 236 is configured to assist the user in removing the foreign substrate collector 88 from the housing 142. It is generally contemplated that the plurality of bristles 238 may be formed using additive manufacturing along the body 234 of the filter 174. It is also contemplated that the bristles 238 may be separately formed and coupled to the body 234. The plurality of bristles 238 are generally rigid relative to the body 234 of the foreign substrate collector 88. The foreign substrates 94 are generally retained by the bristles 238, and the user can remove the foreign substrates 94 from the bristles 238 by removing the foreign substrate collector 88 via the grasping portion 236.

In a further alternate configuration illustrated in FIGS. 1 and 28-33, the foreign substrate collector 88 includes at least one brush 250 disposed along an edge 252 of the lifter 22. The at least one brush 250 is rotatably coupled to the filter 174 of the foreign substrate collector 88 disposed within the housing 142. The at least one brush 250 provides increased collection of the foreign substrates 94 in addition to the plurality of slots 144 defined by the housing 142. The collection of increased foreign substrate 94 is due to the at least one brush 250 being configured to engage with the clothing items 96 within the laundry appliance 10. The engagement between the brush 250 and the clothing items 96 can assist in removing the foreign substrates 94 from the clothing items 96 via frictional engagement. The foreign substrates 94 released may be collected by the brush 250 and/or may pass through the plurality of slots 144 defined in the housing 142. The foreign substrates 94 are ultimately retained by the filter 174 disposed within the housing 142 regardless of the method of collection, as described above with respect to FIGS. 1 and 8-27.

Figure 32:
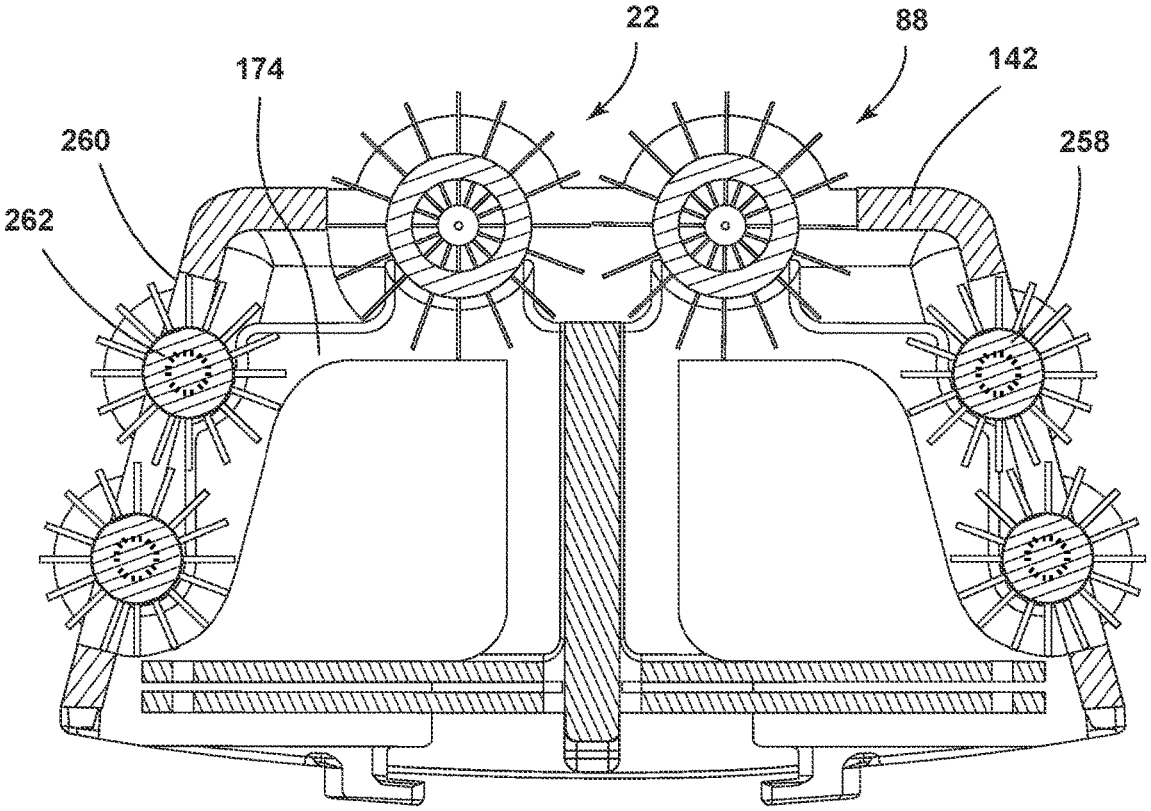
FIG. 32 is an enlarged cross-sectional view of a foreign substrate collector of the present disclosure with a plurality of brushes.
Figure 33:
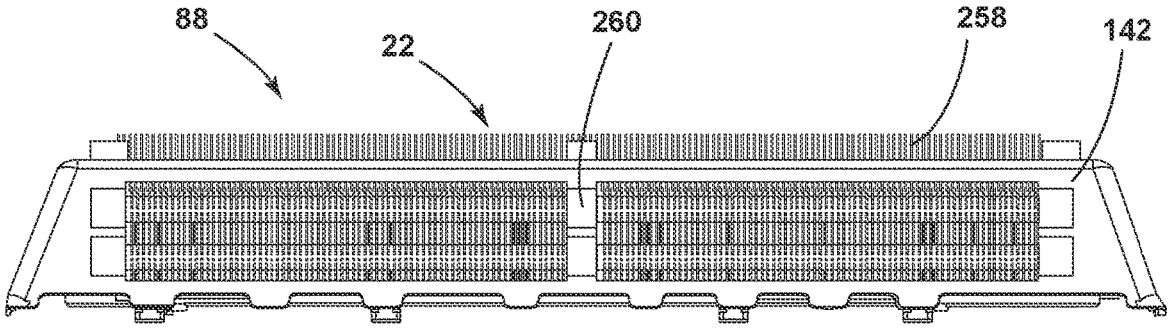
FIG. 33 is a side elevational view of the foreign substrate collector of FIG. 32.

The at least one brush 250 is rotatably coupled to the housing 142 and configured to at least partially engage the filter 174 to remove the foreign substrates 94 collected by the brush 250. The at least one brush 250 may include a first brush 254 and a second brush 256 disposed along the edge 252 of the housing 142. The first and second brushes 254, 256 maximize the interaction between the foreign substrate collector 88 and the clothing items 96 within the drum 18. It is further contemplated that a plurality of brushes 258 may be utilized to remove and collect the foreign substrates 94 within the drum 18 into the foreign substrate collector 88. As illustrated in FIGS. 32 and 33, the plurality of brushes 258 are disposed on each side 260 of the lifter 22, such that side brushes 262 generally extend along the side 260 of the lifter 22. It is generally contemplated that each side 260 of the lifter 22 may include at least two brushes 258 to maximize the number of foreign substrates 94 removed from the clothing items 96 within the drum 18.

Figure 34:
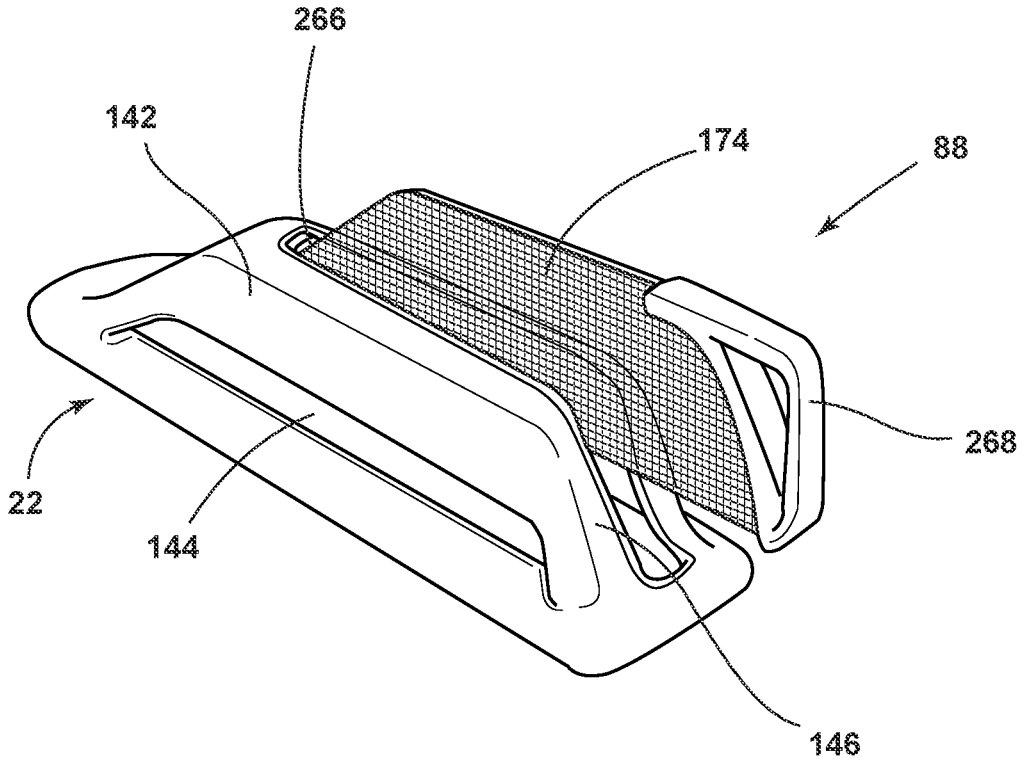
FIG. 34 is a partially exploded top perspective view of a foreign substrate collector of the present disclosure selectively disposed within a lifter.
Figure 35:
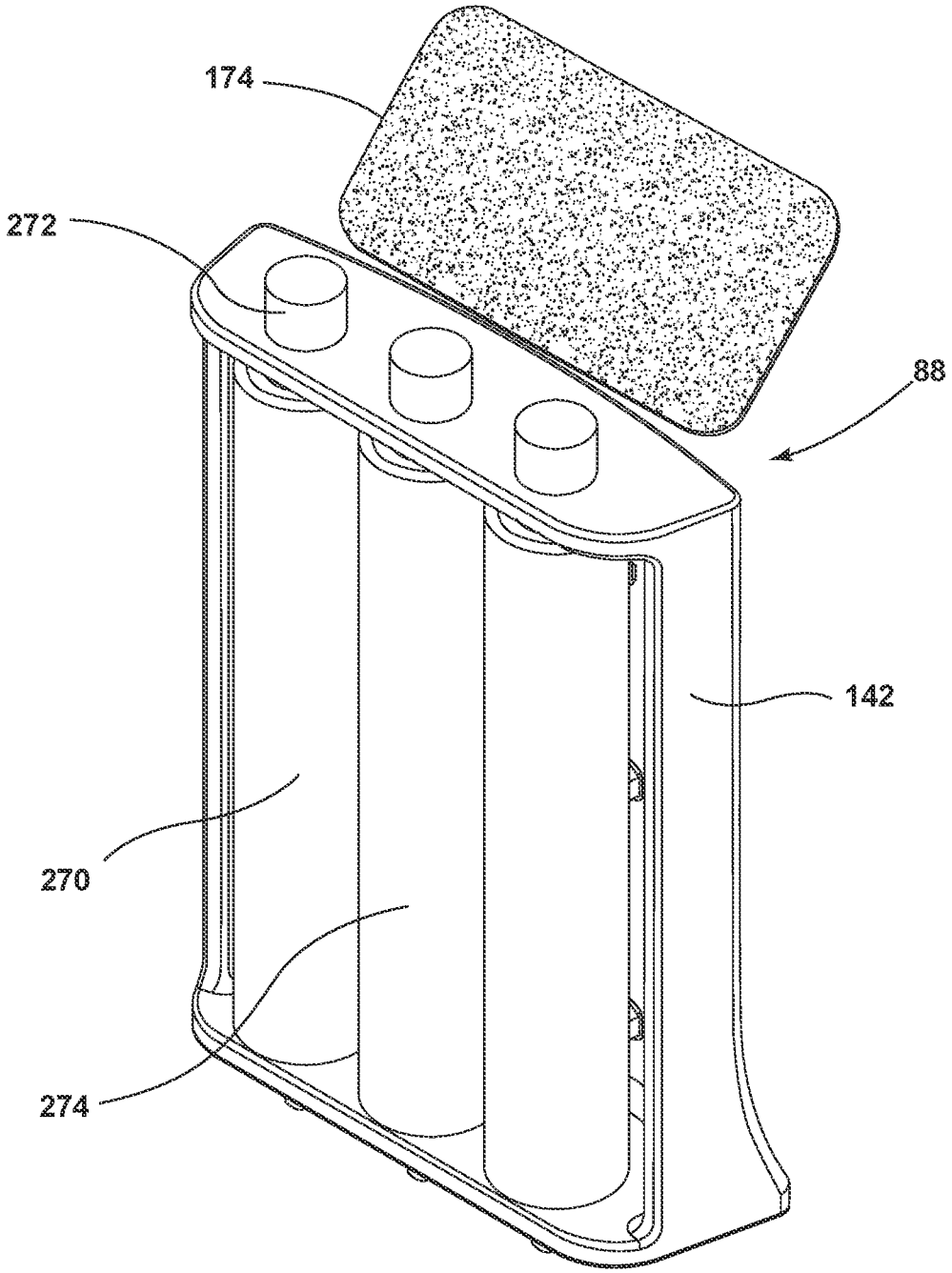
FIG. 35 is a top perspective view of a foreign substrate collector of the present disclosure coupled to a filter.
Figure 36:
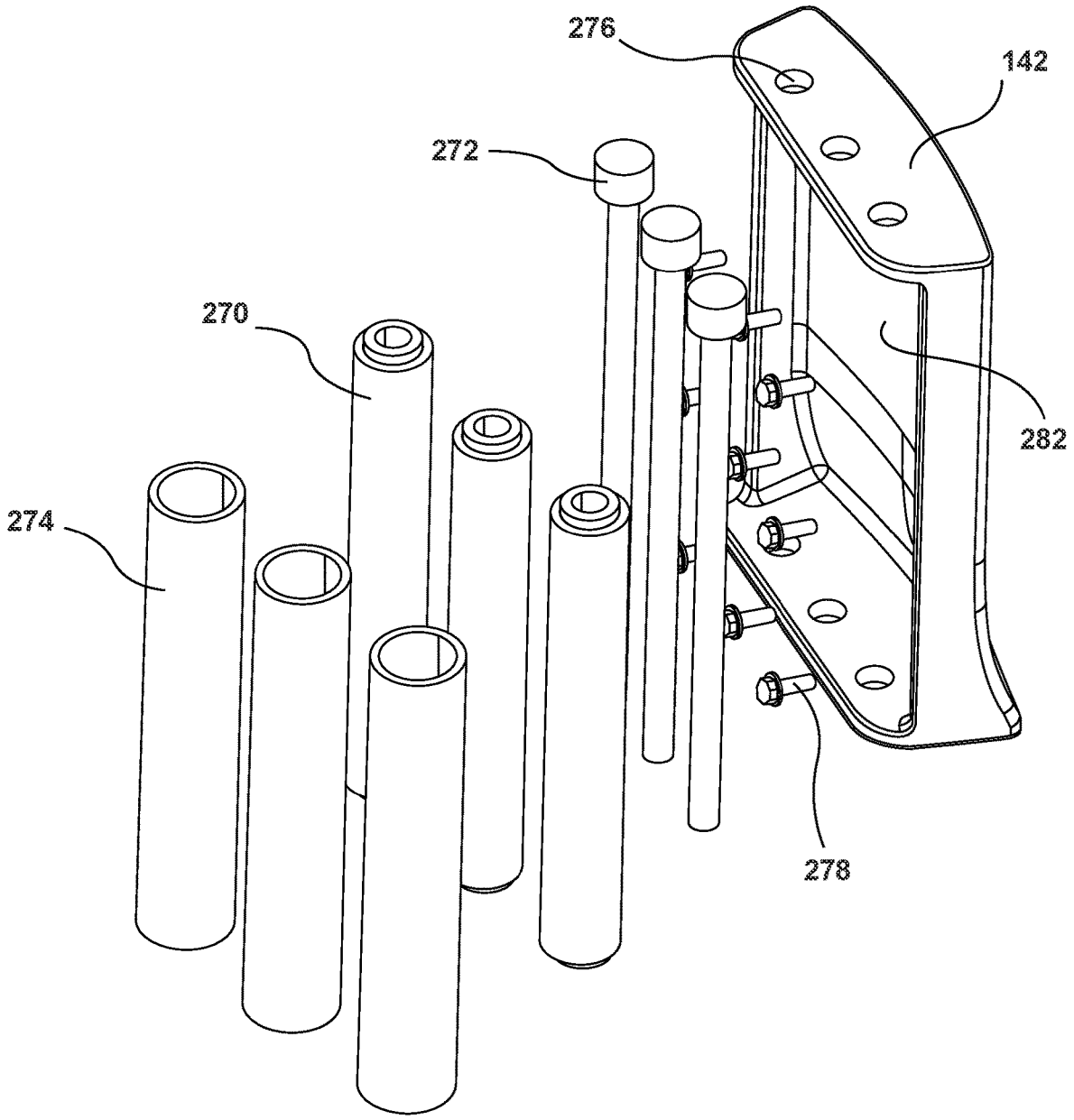
FIG. 36 is an exploded top perspective view of the foreign substrate collector of FIG. 35.
Figure 37:
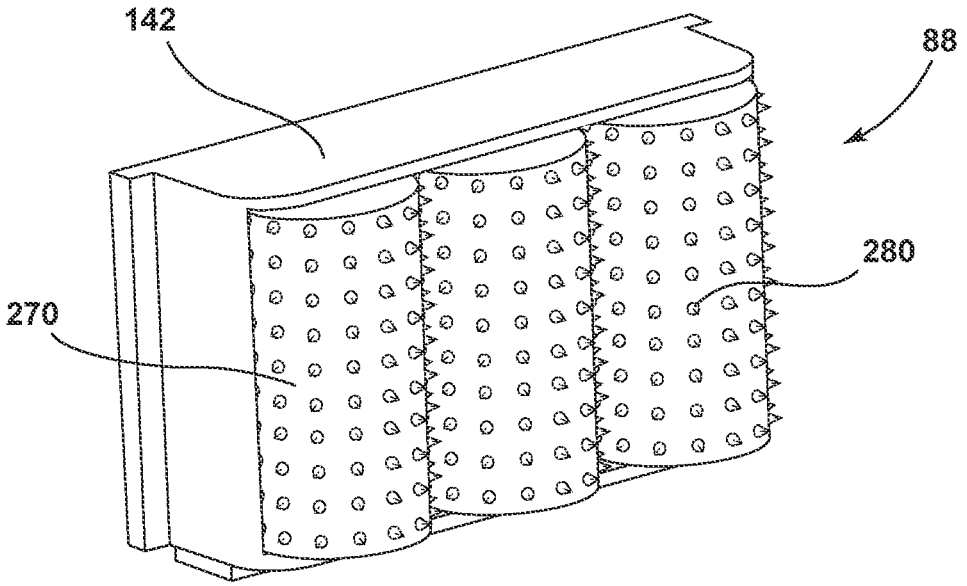
FIG. 37 is a top perspective view of a foreign substrate collector of the present disclosure with protrusions attached to a plurality of rollers.
Figure 38:
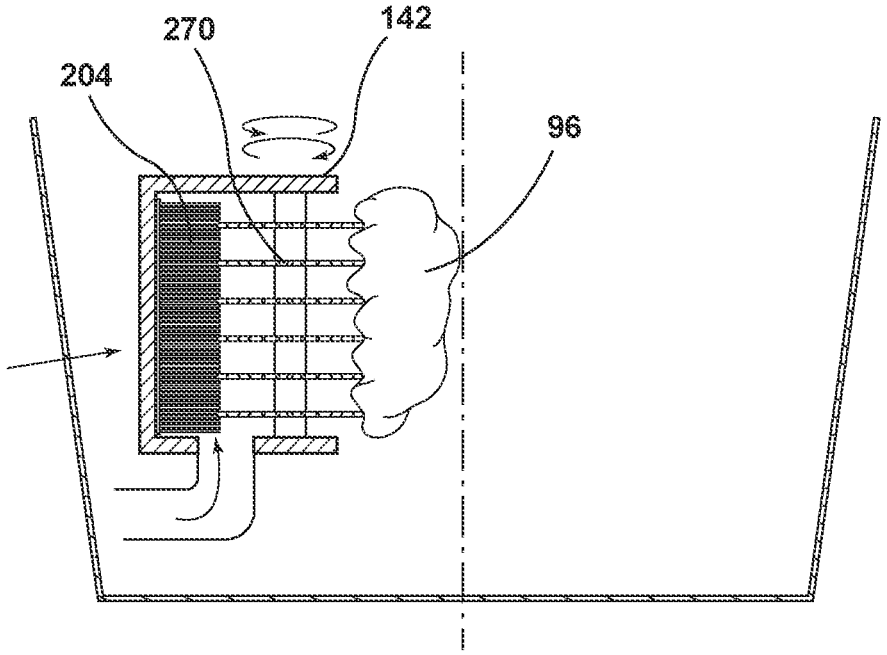
FIG. 38 is a schematic diagram illustrating operation of a foreign substrate collector of the present disclosure.
Figure 39:
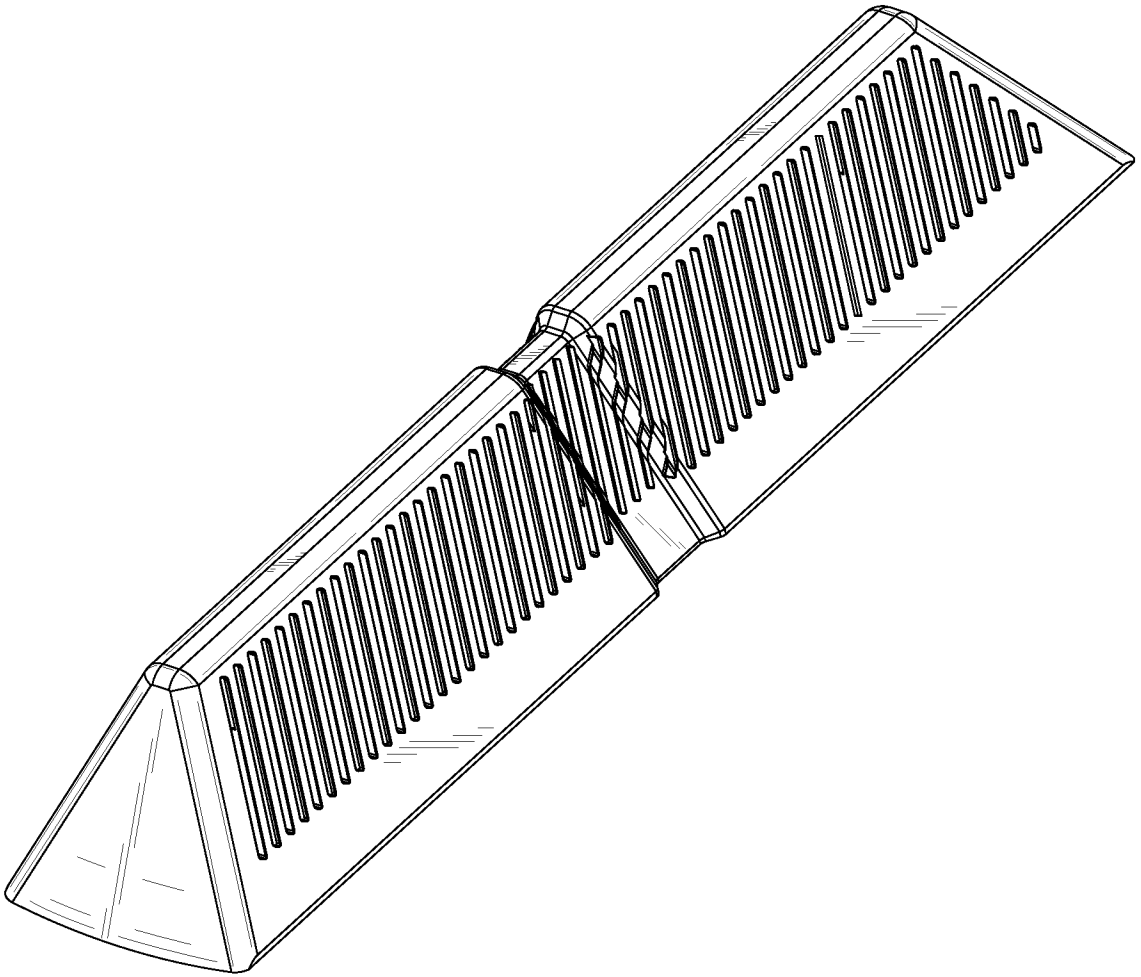
FIG. 39 is a first perspective view of an aspect of a lifter for a laundry appliance.
Figure 40:
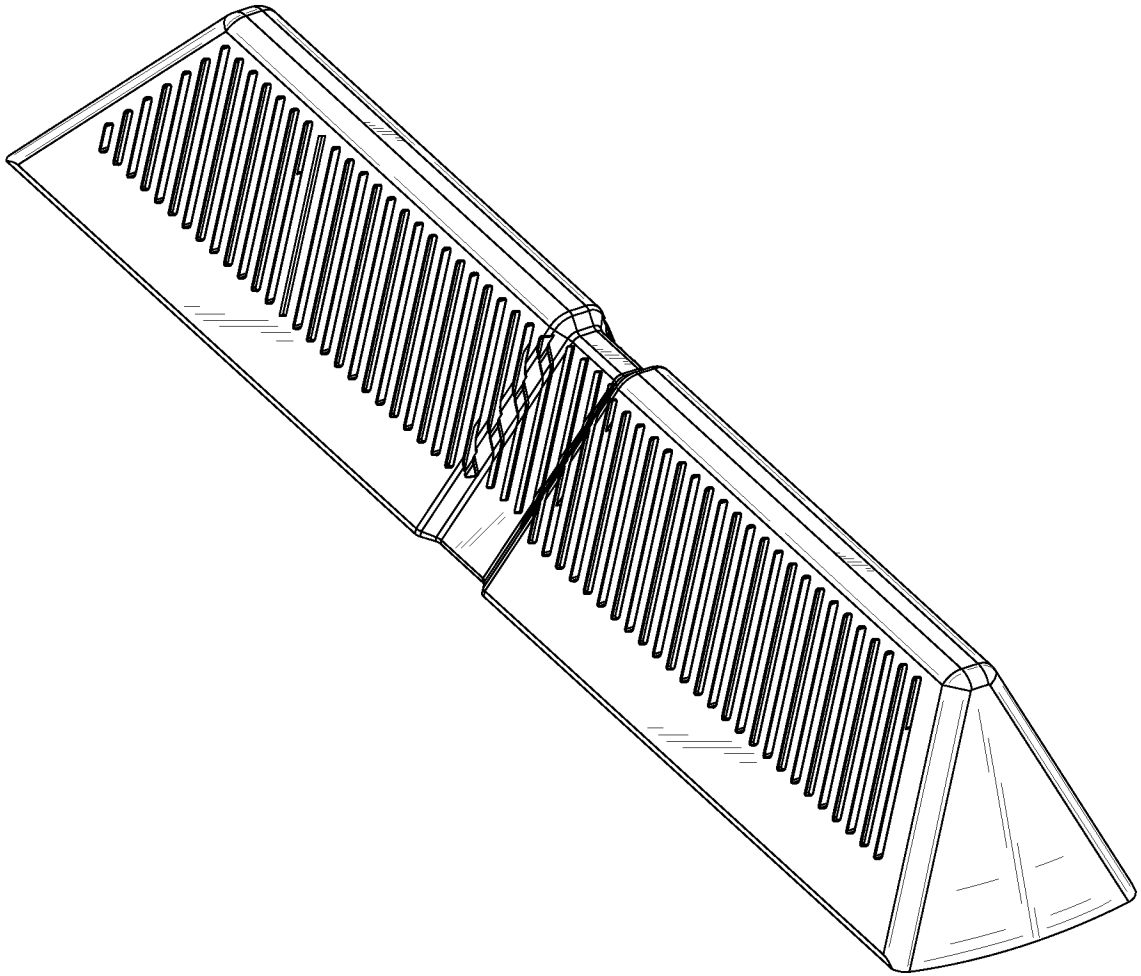
FIG. 40 is a second perspective view of the lifter of FIG. 39.
Figure 41:
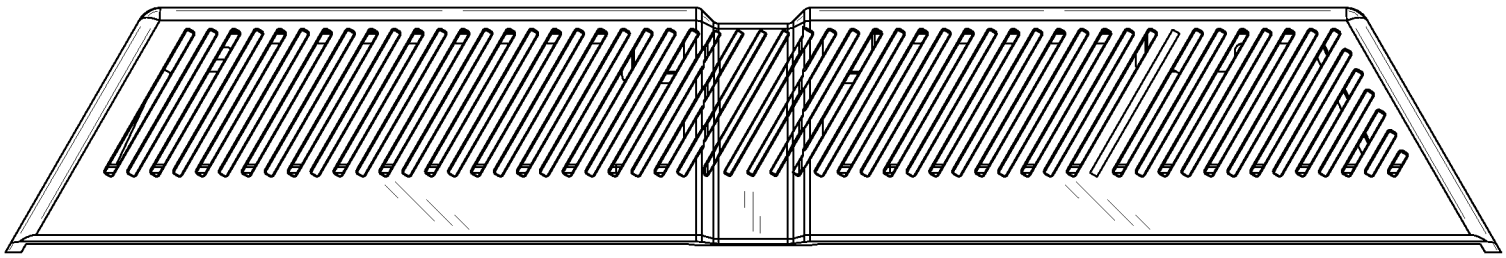
FIG. 41 is a first side elevation view of the lifter of FIG. 39.
Figure 42:
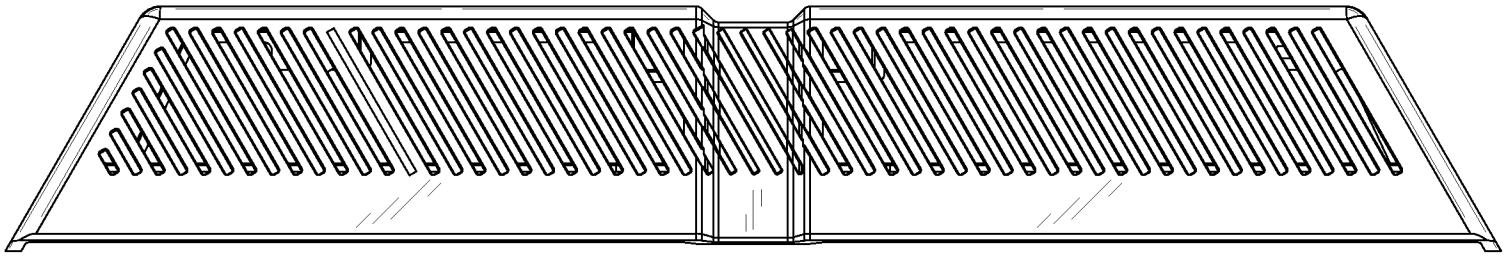
FIG. 42 is a second side elevation view of the lifter of FIG. 39.
Figure 43:
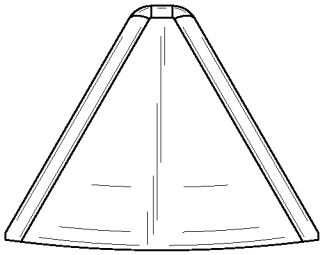
FIG. 43 is a third side elevation view of the lifter of FIG. 39.
Figure 44:
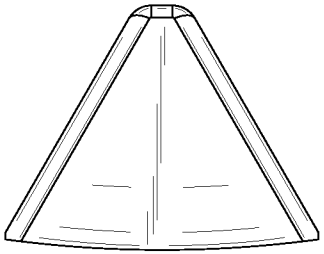
FIG. 44 is a fourth side elevation view of the lifter of FIG. 39.
Figure 45:
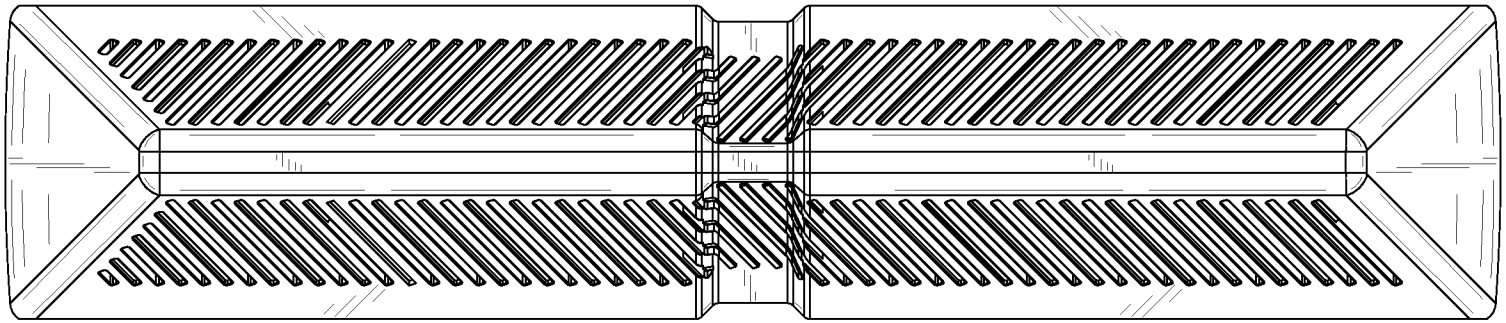
FIG. 45 is a top plan view of the lifter of FIG. 39.
Figure 46:
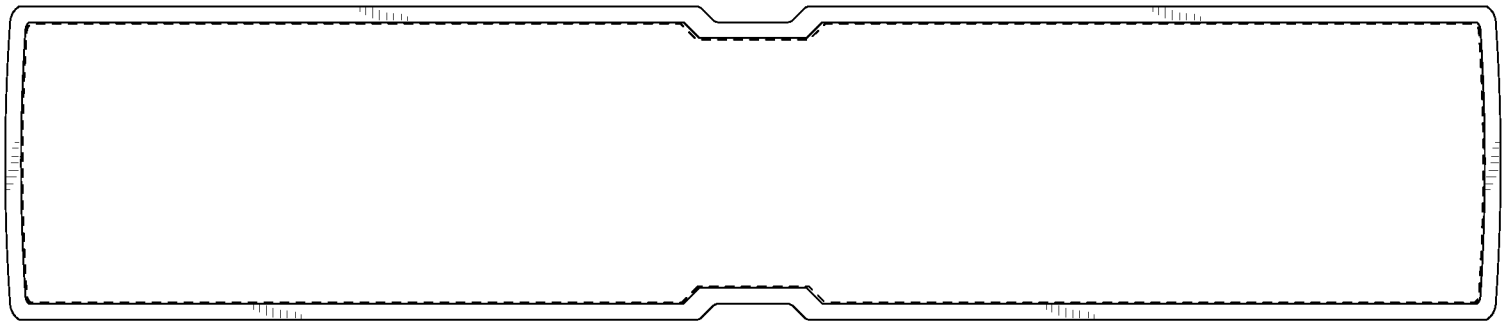
FIG. 46 is a bottom plan view of the lifter of FIG. 39.

Referring to FIGS. 1 and 34, the foreign substrate collector 88 is configured to be removed from the end 146 of the lifter 22 at an angled orientation 266. By utilizing a handle 268 coupled to the filter 174, the user can remove the foreign substrate collector 88 using the angled orientation 266. The foreign substrate collector 88 is generally fixedly retained in the lifter 22 during operation. The angled orientation 266 secures the foreign substrate collector 88, such that during the pet cycle 122 the foreign substrate collector 88 remains fixed. The user can easily remove the foreign substrate collector 88 from the lifter 22 at the angled orientation 266 to remove any foreign substrates 94 collected on the filter 174.

Referring now to FIGS. 1 and 35-38, the foreign substrate collector 88 is illustrated as having the housing 142 that is operably coupled to the filter 174 of the laundry appliance 10. The foreign substrate collector 88 also includes a plurality of rollers 270 that each include a shaft 272 and a frictional member 274. The housing 142 defines guides 276 through which the shafts 272 of the plurality of rollers 270 extend to couple the rollers 270 to the housing 142. The shafts 272 are rotatably coupled to the housing 142 within the guides 276. The housing 142 is operably coupled to the filter 174 of the laundry appliance 10 via fasteners 278. The fasteners 278 are illustrated as bolts extending through the housing 142. However, it is generally contemplated that the fasteners 278 may include screws, magnets, or other fasteners generally known in the art. The foreign substrate collector 88 and the filter 174 are selectively removable from the drum 18, so the user can clean the foreign substrates 94 from the frictional members 274 of the foreign substrate collector 88.

It is generally contemplated that the clothing items 96 engage the frictional members 274 of the foreign substrate collector 88 during the selected laundry cycle. The foreign substrates 94 that may be disposed on the clothing items 96 may be removed from the clothing items 96 by the frictional members 274. The plurality of rollers 270 are configured to rotate within the housing 142. It is also contemplated that the plurality of rollers 270 may have a degree of resistance relative to the housing 142 to promote the frictional engagement between the clothing items 96 and the frictional members 274. In an alternate configuration, the filter 174 may be coupled to the housing 142 and the frictional members 274. In this configuration, the foreign substrates 94 collected by the frictional members 274 may be ultimately transferred to the filter 174. The user can remove the filter 174 to remove the foreign substrates 94 from the drum 18 prior to a new laundry cycle.

With further reference to FIGS. 1 and 35-38, the frictional members 274 may be formed from a generally sticky or tacky material to attract and retain the foreign substrates 94 from the clothing items 96. By way of example, not limitation, the frictional members 274 may be formed from a silicone material, or other similar material that has a generally tacky exterior. It is also contemplated that the frictional members 274 may be formed from other polymeric materials known in the art, such as rubber, that is configured to be tacky or otherwise sticky to attract and retain the foreign substrates 94. The frictional members 274 can also be formed from static producing materials that can be used to generate a static charge when rubbed or otherwise moved against other materials.

In an alternate configuration, the frictional members 274 may include protrusions 280 that outwardly extend from the rollers 270. The protrusions 280 are configured to engage the clothing items 96, similar to the brush 250 mentioned above, to remove and collect the particles of foreign substrates 94. In addition, the housing 142 of the foreign substrate collector 88 may include a static member 282 that is configured to engage the frictional members 274 and generate a charge along each of the rollers 270. The charge along the rollers 270 is an opposing charge to that of the particles of foreign substrates 94. The charge on the rollers 270 generally helps attract the particles of foreign substrates 94 to the rollers 270 to collect the particles of foreign substrates 94 within the foreign substrate collector 88.

Referring again to FIGS. 1-38, the laundry appliance 10 described herein is configured to maximize the removal of foreign substrates 94 from the clothing items 96. The foreign substrates 94 include, but are not limited to, pet hair that may be disposed on the clothing items 96 prior to a wash cycle 172. The laundry appliance 10 described herein is configured to remove the foreign substrates 94 via the various configurations of the foreign substrate collector 88 and various wash cycles 172. The foreign substrate collector 88 can be used in either a washer and/or dryer construction of the laundry appliance 10, depending on the needs of the user. Ultimately, the foreign substrate collector 88 allows the user to have clothing items 96 that are free from foreign substrates 94 by simply running a laundry cycle.

The invention disclosed herein is further summarized in the following paragraphs and is further characterized by combinations of any and all of the various aspects described therein.

According to another aspect of the present disclosure, a laundry appliance includes a cabinet. A door is operably coupled to the cabinet. A drum is disposed within the cabinet proximate to the door. A lifter is disposed within and operably coupled to the drum. A foreign substrate collector is disposed within the lifter.

According to another aspect, the foreign substrate collector includes a housing that defines a filter space therein. The foreign substrate collector includes a filter that is disposed within the filter space.

According to yet another aspect, the foreign substrate collector includes at least one brush that is configured to agitate clothing items disposed within the drum.

According to another aspect of the present disclosure, the at least one brush includes bristles that extend outside of a housing of the lifter.

According to another aspect, the at least one brush includes a roller that rotates about a shaft. The shaft and a portion of the at least one brush is positioned within a housing of the lifter.

According to yet another aspect, the foreign substrate collector includes a body having a plurality of bristles disposed along a length of the body.

According to another aspect of the present disclosure, a blower is operably coupled to the cabinet and is configured to direct airflow within the drum. The blower is configured to direct a flow of process air through lifters and the foreign substrate collector.

According to another aspect, a controller is configured to execute a pet cycle of said laundry appliance. The pet cycle operates to direct at least one of a flow of process air and a flow of wash fluid through the foreign substrate collector.

According to yet another aspect, the pet cycle includes a pre-wash air cycle that directs the flow of process air through the foreign substrate collector.

According to another aspect of the present disclosure, a fluid delivery system delivers the flow of the wash fluid to the drum. The fluid delivery system delivers a first level of the wash fluid during a standard wash cycle. The fluid delivery system delivers a second level of the wash fluid during the pet cycle. The second level is higher than the first level. The pet cycle is configured to direct the flow of the wash fluid through the foreign substrate collector.

According to another aspect, the door is attached to a front panel of the cabinet and the drum rotates about one of a horizontal axis and an angled axis.

According to yet another aspect, the door is attached to a top panel of the cabinet and the drum rotates about a vertical axis.

According to another aspect of the present disclosure, a laundry appliance includes a cabinet. A door is operably coupled to the cabinet and includes a barrier layer. A drum is disposed within the cabinet proximate to the door. A lifter is disposed within and operably coupled to the drum. A foreign substrate collector is disposed proximate the barrier layer.

According to another aspect, the door includes a first filter and a second filter operably coupled to the barrier layer of the door.

According to yet another aspect, a ventilation assembly operably coupled to the first filter. An external receiving container is operably coupled to the second filter.

According to another aspect of the present disclosure, the second filter delivers process air from the drum, through the second filter and into the external receiving container. The first filter defines a recovery air opening for delivering ambient air from around the cabinet into the drum via the ventilation assembly.

According to another aspect, the second filter is defined within a deflector of the barrier layer of the door.

According to yet another aspect, the first and second filters are operable to an open position during a pet cycle. The first and second filters are operable to a closed position during a standard cycle.

According to another aspect of the present disclosure, a laundry appliance includes a cabinet. A door is operably coupled to the cabinet. A drum is disposed within the cabinet proximate to the door. A lifter is disposed within and operably coupled to the drum. A foreign substrate collector is disposed proximate the drum. The foreign substrate collector includes a plurality of rollers with frictional members. The frictional members rotate against one another and against articles being processed. The frictional members collect foreign substrate particles from the articles and collects the foreign substrate particles on the plurality of rollers.

According to another aspect, the frictional members include static producing materials. The plurality of rollers engage one another to generate a static charge that attracts the foreign substrate particles.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance, comprising:

a cabinet;

a door operably coupled to the cabinet;

a drum disposed within the cabinet proximate to the door;

a lifter disposed within and operably coupled to the drum; and a foreign substrate collector disposed within the lifter, the foreign substrate collector including a filter disposed within the lifter and a brush having a roller that rotates about a shaft, wherein the brush rotates about the shaft and engages the filter to selectively transfer collected particulate matter from the brush and to the filter.

2. The laundry appliance of claim 1, wherein the foreign substrate collector includes a housing that forms at least a portion of the lifter and defines a filter space therein, wherein the filter is selectively removable from the filter space.

3. The laundry appliance of claim 1, wherein the brush includes at least one agitating brush that is configured to agitate clothing items disposed within the drum.

4. The laundry appliance of claim 3, wherein the at least one agitating brush includes brush bristles that extend outside of a housing of the lifter.

5. The laundry appliance of claim 3, wherein the shaft and a portion of the brush is positioned within a housing of the lifter to engage the filter.

6. The laundry appliance of claim 1, wherein the foreign substrate collector includes a body having a plurality of bristles disposed along a length of the body.

7. The laundry appliance of claim 1, further comprising:

a blower operably coupled to the cabinet and configured to direct airflow within the drum, wherein the blower is configured to direct a flow of process air through lifters and the foreign substrate collector; and a fluid delivery pump that delivers a flow of wash fluid to the drum.

8. The laundry appliance of claim 7, further comprising:

a controller configured to execute a particulate capturing cycle of said laundry appliance, wherein the particulate capturing cycle operates to direct at least one of the flow of the process air and the flow of the wash fluid into the drum, wherein the lifters include a diverter that directs the process air through the foreign substrate collector.

9. The laundry appliance of claim 8, wherein the particulate capturing cycle includes a pre-wash air cycle that directs the flow of the process air through the foreign substrate collector, wherein the pre-wash air cycle is defined by operation of the blower and rotation of the drum in advance of a wash cycle being initiated.

10. The laundry appliance of claim 8, wherein the fluid delivery pump delivers a first level of the wash fluid to the drum during a standard wash cycle, and wherein the fluid delivery pump delivers a second level of the wash fluid to the drum during the particulate capturing cycle, wherein the second level is higher than the first level, wherein the controller during the particulate capturing cycle is configured to direct the flow of the wash fluid through the foreign substrate collector.

11. The laundry appliance of claim 1, wherein the door is attached to a front panel of the cabinet and the drum rotates about one of a horizontal axis and an angled axis.

12. The laundry appliance of claim 2, wherein the door is attached to a top panel of the cabinet and the drum rotates about a vertical axis.

13. A laundry appliance, comprising:

a cabinet;

a door operably coupled to the cabinet and including a barrier layer;

a drum disposed within the cabinet proximate to the door;

a lifter disposed within and operably coupled to the drum;

a foreign substrate collector disposed proximate the barrier layer, wherein the foreign substrate collector includes a first filter and a second filter operably coupled to the barrier layer of the door;

a ventilation assembly operably coupled to the first filter; and an external receiving container operably coupled to the second filter and positioned external to the cabinet, wherein an air handler of the external receiving container generates a suction that draws foreign substances from the second filter and the drum for retention within the external receiving container.

14. The laundry appliance of claim 13, wherein the second filter delivers process air from the drum, through the second filter and into the external receiving container, and wherein the first filter defines a recovery air opening for delivering ambient air from around the cabinet into the drum via the ventilation assembly.

15. The laundry appliance of claim 13, wherein the second filter is defined within a deflector of the barrier layer of the door.

16. A laundry appliance, comprising:

a cabinet;

a door operably coupled to the cabinet;

a drum disposed within the cabinet proximate to the door;

a lifter disposed within and operably coupled to the drum; and a foreign substrate collector disposed proximate the drum, wherein the foreign substrate collector includes a plurality of rollers with frictional members, wherein the frictional members rotate against one another and against articles being processed, wherein the frictional members collect foreign substrate particles from the articles and collects the foreign substrate particles on the plurality of rollers.

17. The laundry appliance of claim 16, wherein the frictional members include static producing materials, and wherein the foreign substrate collector includes a static member that engages the static producing materials of the frictional members to generate a static charge that attracts the foreign substrate particles.

18. The laundry appliance of claim 16, wherein the foreign substrate collector is incorporated within the lifter.

19. The laundry appliance of claim 16, wherein the foreign substrate collector is operably coupled to a rear portion of the drum.

20. The laundry appliance of claim 16, wherein the foreign substrate collector is disposed within a housing of the lifter.

* * * * *